US012320548B2

(12) United States Patent
Fischmann et al.

(10) Patent No.: US 12,320,548 B2
(45) **Date of Patent: *Jun. 3, 2025**

(54) LOCALIZED HEATING SYSTEM FOR LARGE WATER BODIES WITH A PARTIAL CONFINEMENT SYSTEM

(71) Applicant: CRYSTAL LAGOONS TECHNOLOGIES, INC., Miami, FL (US)

(72) Inventors: Fernando Fischmann, Coral Gables, FL (US); Jose Amigo Alvarez, Vitacura Santiago (CL)

(73) Assignee: Crystal Lagoons Technologies, Inc., Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/537,415

(22) Filed: Dec. 12, 2023

(65) Prior Publication Data

US 2024/0110724 A1 Apr. 4, 2024

Related U.S. Application Data

(63) Continuation of application No. 17/560,518, filed on Dec. 23, 2021, now Pat. No. 11,892,195.

(60) Provisional application No. 63/132,644, filed on Dec. 31, 2020.

(51) Int. Cl.
*E02B 3/00* (2006.01)
*F24H 1/00* (2022.01)

(52) U.S. Cl.
CPC ..... *F24H 1/0072* (2013.01); *E02B 3/00* (2013.01)

(58) Field of Classification Search
CPC ..... F24H 1/0072; E02B 3/00
See application file for complete search history.

(56) References Cited

U.S. PATENT DOCUMENTS

| | | | |
|---|---|---|---|
| 3,460,166 | A | 8/1969 | Weber |
| 3,621,496 | A | 11/1971 | McWilliams |
| 3,922,732 | A | 12/1975 | Friedel |
| 3,934,472 | A | 1/1976 | Bradham |
| 4,498,454 | A | 2/1985 | Assaf |
| 4,628,906 | A | 12/1986 | Tonoli |
| 4,706,307 | A | 11/1987 | Smith |
| 7,870,621 | B2 | 1/2011 | Zeng |
| 11,124,980 | B1 | 9/2021 | Magda |

(Continued)

FOREIGN PATENT DOCUMENTS

CN 109208426 B 12/2020

OTHER PUBLICATIONS

International Search Report and Written Opinion for PCT/US2021/065093. (May 2, 2022).

*Primary Examiner* — Kyle Armstrong
(74) *Attorney, Agent, or Firm* — Merchant & Gould, P.C.

(57) ABSTRACT

The present invention comprises a system for the localized heating of a portion of water within larger water bodies through a partial confinement of said portion of water without completely interrupting the water flow and where the concept of being in the same water body is maintained, in order to facilitate the practice of recreational activities in a heated environment. The present invention provides a solution to achieve a comfortable temperature of the water for direct contact recreational purposes in a cost-efficient manner, with a partial confinement system that allows creating a heat plug and provides for a serpentine-type flow between both sides of the partial confinement system.

66 Claims, 10 Drawing Sheets

(56) References Cited

U.S. PATENT DOCUMENTS

| | | | |
|---|---|---|---|
| 11,892,195 | B2 | 2/2024 | Fischmann et al. |
| 2007/0049385 | A1 | 3/2007 | Henry et al. |
| 2010/0095448 | A1 | 4/2010 | Goldmann et al. |
| 2017/0191237 | A1 | 7/2017 | Fishmann Torres |

LOCALIZED HEATING SYSTEM FOR LARGE WATER BODIES WITH A PARTIAL CONFINEMENT SYSTEM

CROSS-REFERENCE TO RELATED APPLICATIONS

This application is a continuation of U.S. patent application Ser. No. 17/560,518, filed Dec. 23, 2021, which claims the benefit of U.S. Provisional Patent Application No. 63/132,644, filed Dec. 31, 2020. The disclosure of these priority applications in their entirety is hereby incorporated by reference into the present application.

FIELD OF THE INVENTION

The present invention relates to the field of technologies for improving and extending the usability of natural and man-made large bodies of water for recreational purposes. The present invention provides a system that allows partially confining a portion of water within a larger natural or man-made body of water and to adjust the temperature of the partially confined area without requiring a physical barrier that completely encloses and confines such area. The system of the present invention therefore allows providing an area having a more pleasant temperature than the rest of the body of water while providing swimmers and bathers an immersive experience within the large water body in contrast to the enclosed environment that separate swimming pools and secluded swimming areas create within large bodies of water.

BACKGROUND OF THE INVENTION

Historically, people have always enjoyed spending time in or around outdoor swimming pools, lakes, rivers and other natural water bodies, aiming to carry out activities inside the water such as swimming, practicing water sports, playing games, enjoying "a day in the water". Human beings, physiologically, look for temperatures of the water of around 25-30° C., more preferably between 26-28° C., which are perceived as comfortable for recreational bathing purposes.

However, most of the water bodies present in the world do not normally or naturally achieve such temperature ranges, or achieve them only over short periods of time within the year.

For example, seawater temperature over the coast of San Diego, California varies from an average of 14-21° C. over the year, while the temperature at Lake Michigan varies from an average of 2-21° C. over the year. As another example, the seawater temperature at Sydney, Australia varies from an average of 20-24° C. over the year, while the seawater temperature in Tokyo, Japan varies from an average of 14-25° C. over the year (see, e.g., Seawater and Lake Temperatures at www.seatemperature.org/australia-pacific/Australia/sydney.htm). Likewise, the sea temperature at the Mediterranean is generally very warm, reaching up to 26° C. in the months of July, August, and September, providing relatively comfortable conditions for enjoying water activities. Nevertheless, during early spring, sea temperatures reach lows of about 15° C.

Cities closer to the equator have more stable high temperatures, such as in Cancun, Mexico with seawater temperatures with averages of 25-28° C. over the year, for example. The sea water of the Caribbean, for example, is warm with an average water temperature of around 27° C. and generally varies as little as 3° C. throughout the year, providing thus optimal conditions for swimming and recreational activities. However, Caribbean (Tropical) climate is unique and generally not accessible for most of the population. In any case, there are periods of time within the Caribbean waters where the temperatures, although warmer than in other locations, still do not achieve comfortable bathing temperatures, and therefore are not used for direct contact recreational purposes during such times.

Further, man-made water bodies have generally the same type of behaviour in terms of water temperatures, which may even be more extreme than in natural water bodies as generally man-made water bodies have lower depths, surfaces, and volumes for example, which make them more prone to changes in their temperature. In some cases, man-made water bodies present lower temperatures than natural ones, and can even freeze in some locations whereas natural water bodies may not. These man-made water bodies therefore also do not generally present optimum nor comfortable temperatures for swimming and recreational activities.

Therefore, only a very small part of natural or man-made large water bodies around the world are able to comply with the aforementioned comfort temperatures in the range of about 26-28° C. over a long period of time or permanently. For this same reason, it is known that most of the outdoor water bodies are visited and enjoyed mainly during the summer time or warm periods of the year.

For example, a study published in the Journal of Ocean and Coastal Management collected annual beach attendance data for 75 beaches along the 350 km of coastline in Southern California for the years 2000-2004. The study shows that on average, over 129 million beach visits occur each year, with the majority (54%) of visits occurring at only 15 beaches, and that 53% of the total visits ocurr in June, July and August, which are the summer months with higher average temperature (see Dwight, R. H., Brinks, M. V., SharavanaKumar, G., & Semenza, J. C. (2007). Beach attendance and bathing rates for Southern California beaches. Ocean & Coastal Management, 50(10), 847-858). When oceans, lakes, reservoirs, lagoons, or other natural or man-made large water bodies do not present comfortable temperatures, they have very low usage rates and are generally only used for limited water sports and where people use an isolating suit to avoid feeling such low temperatures.

It is important to note that water temperature is also a very important driver for tourism, and demand for hot-spots in terms of recreational water activities is greatly sought by people all over the world to enjoy comfortable swimming and recreational bathing activities.

Large water bodies, such as the ocean, or lakes, reservoirs, lagoons, or ponds have temperatures that depend on the natural environmental and weather conditions, where such water bodies have an equilibrium temperature that is based on the air temperature, water density, relative humidity, exposure to the sun, cloud cover conditions, and precipitation conditions, among others. This generally results in cold temperatures, and given the large volumes of such water bodies, they cannot be artificially heated to a temperature that is comfortable for swimming and direct contact purposes on an all year-round basis in a cost-efficient way, given that there are no systems that are able to maintain a pleasant water temperature in large water bodies at low costs.

In order to address this limitation in large water bodies such as lakes or man-made lagoons, an alternative has been to build independent enclosed pools in the vicinity of such large water bodies, those pools having independent recirculation means that allows them to be heated for a certain period of time or while visitors are present in their premises. This solution however, does not allow providing the people with an "immersive" experience of swimming in the lake or man-made lagoon, but just in an outdoor swimming pool next to the large water body.

Several limitations arise when attempting to heat, or increase the temperature of a large water body. Heat tends to dissipate naturally to the ambient air, especially in water bodies having a large surface (i.e., a large heat transfer area) and in locations where the difference between the water temperature and ambient air temperature is high, due to the natural occurring processes of thermal equilibrium.

Therefore, a first limitation arises if the complete water body needs to be heated. If such large water bodies have to be heated entirely to provide comfortable temperatures for bathers of within 26-28° C., the amount of heat and energy necessary to achieve such pleasant temperature would be extremely high, aside from the associated heat distribution systems and equipment required to provide such thermal loads, which would be very expensive and complex to generate, and would have very high thermal losses and inefficiencies. This results in that large water bodies cannot be heated with a technically and economically viable technology in order to provide pleasant temperatures for bathers, and therefore bathers generally do not use such large water bodies for direct contact recreational purposes during most times during the year.

A second limitation arises even when attempting to heat small portions of large bodies of water without the need of a physical barrier that completely blocks the flow of water, as it becomes fairly difficult and expensive to maintain a small portion of the body of water with a higher temperature, given the natural effect of heat dissipation and the influence of water currents. This is why most of the currently existing solutions rely on constructing an fully confined swimming pool in the vicinity of the large water body, having its own independent circulation and heating systems.

As it can be seen, it is extremely important to provide solutions that do not require heating the complete body of water to provide pleasant temperatures for bathers to swim and practice direct contact recreational activities, and that can have a worldwide impact and change in the tourism and recreation industries, allowing to enable and/or extend the use of such water bodies for direct contact purposes by providing an immersive experience within the larger natural or man-made water body.

DESCRIPTION OF THE PRIOR ART

Several attempts have been made to increase the temperature of a water body in order to allow people to swim and enjoy the water with a more pleasant temperature. Many of these attempts require fully confining a zone of the body of water in order to completely block the flow of water from the water body to the confined zone. Even though a full barrier to separate a confined zone containing the heated water may be created, such solution does not allow an hydraulic connection of both water volumes and therefore has a direct impact of the confined volume water quality. In contrast, the present invention in a cost-efficient way allows for localized heating of partially confined area that is hydraulically connected to the rest of the body of water.

U.S. Pat. No. 3,922,732 describes a method and system for providing heated swimming pools in a limited area of a larger body of water by using a heat barrier extending along a substantially closed boundary but terminating at a distance from the bottom to delimit a downwardly open enclosure, as well as first and second piping means connected to a heat pump that abstracts heat from water circulating through the second conduit means in order to heat the water circulating through the first conduit means to increase the temperature of the swimming pool.

Austrian Patent AT 411477B describes a floating swimming pool structure comprising a support structure and elements, a buoyancy element, enclosing lateral walls that enclose the swimming area laterally and a bottom element bounding the swimming pool volume, where the walls and bottom comprise openings for water to pass through, and a system for heating the water inside of the swimming pool, where at least one inflow nozzle is located at the bottom element for supplying heated water to the floating swimming pool. This system and the use of the side walls and bottom wall aim to protect the swimming pool against the ingress of living beings (animals) from outside the pool.

European Patent EP 0771917B1 describes an installation and process for heating a part of an at least substantially stagnant body of water, impounded by floating hollow bodies as well as skirts suspended from the floating hollow bodies, and where the water inside the impounded water body is heated by recirculating the water from the impounded part through a heating source, where the heated water is fed to the impounded part through downward sloping jets and water is withdrawn from such impounded part from the opposite side of the feeding jets.

SUMMARY

The present invention discloses a method for the localized heating of a portion of water within larger water bodies, which provides a solution to achieve a comfortable temperature of the water for direct contact recreational purposes in a cost-efficient manner, with a partial confinement system that does not completely interrupt the water flow and that allows keeping the concept of being in the same water body. The present invention also discloses a localized heating system for creating partially confined heated zones within larger water bodies, where the partial confinement system creates a heat plug and provides for a serpentine-type flow between both sides of the partial confinement system.

The present invention describes a system for the partial confinement of a water body that creates a thermal barrier and heat plug between two distinct areas within the water body (1) while maintaining the concept of being in the same water body, comprising:

- A first barrier element FBE (2*a*) positioned from the bottom (4) of the water body (1) in a substantially upwardly position, wherein the first barrier element (2*a*) has a vertical length of up to about 95% of the water depth of the water body (1) where such first barrier element is positioned;
- A second barrier element SBE (2*b*) positioned from the surface (6) of the water body (1) in a substantially downwardly position, where the second barrier element (2*b*) has a submerged depth of up to 95% of the water depth of the water body (1) where such second barrier element is positioned;
- wherein the first and second barrier elements form an overlap length (OL), and wherein the second barrier unit (2*b*) is located at a horizontal distance (HD) from the first barrier element (2*a*), which creates a transition zone (4); and wherein the horizontal distance (HD) is greater than zero.

The present invention also describes a localized heating system for creating partially confined heated zones (3) within larger water bodies (1), comprising:

- A first barrier element FBE (2*a*) positioned from the bottom (4) of the water body (1) in a substantially upwardly position, wherein the first barrier element (2*a*) has a vertical length of up to about 95% of the water depth of the water body (1) where such first barrier element is positioned;
- A second barrier element SBE (2*b*) positioned from the surface (6) of the water body (1) in a substantially downwardly position, where the second barrier element (2*b*) has a submerged depth of up to 95% of the water depth of the water body (1) where such second barrier unit is positioned,
- wherein the first and second barrier elements form an overlap length (OL), and wherein the second barrier unit (2*b*) is located at a horizontal distance (HD) from the first barrier element (2*a*), which creates a transition zone (4); and wherein the horizontal distance (HD) is greater than zero;
- At least one water intake point (9) to withdraw water from the water body (1);
- At least one heated water discharge point (8) to discharge heated water into the partially confined zone (3); and
- At least one heating system (7) configured to increase the temperature of the water flow withdrawn from the water intake point (9) and then returns the heated water flow to the partially confined zone (3) through at least one heated water discharge point (8)

DETAILED DESCRIPTION OF THE INVENTION

Figure 1:
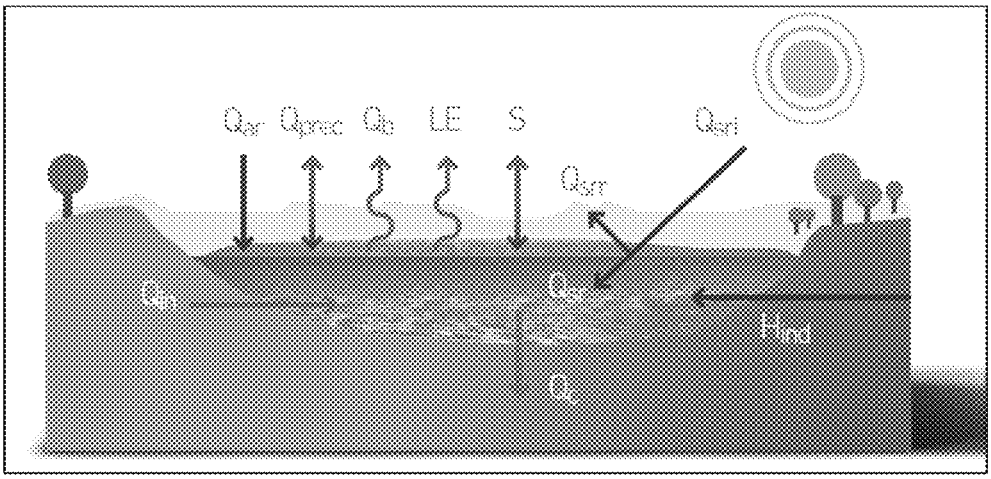
FIG. 1 shows a general overview of the heat dissipation and loss from water bodies in terms of heat flux.
Figure 2:
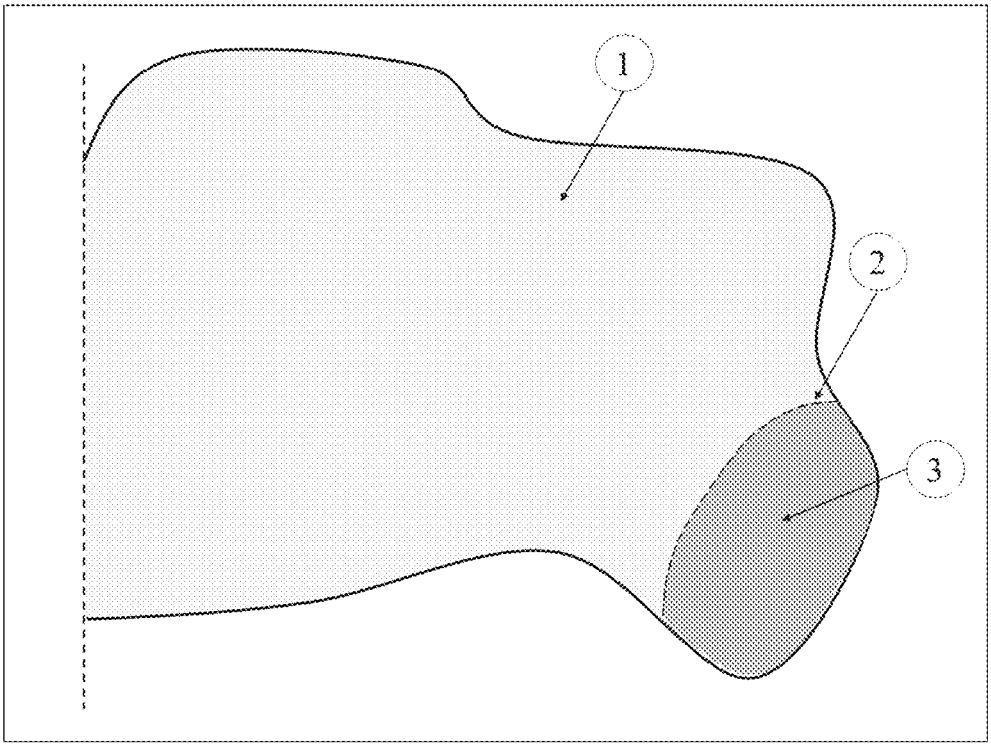
FIG. 2 shows a schematic aerial view of a water body (1) where a system according to the invention may be implemented, showing the location of the partial confinement system (2) for a creating a partially confined area (3).

The present invention discloses a partial confinement system that allows for a serpentine-type flow between both sides of the partial confinement system and at the same type creating a heat plug between a partially confined portion of water and the rest of the water body. The present invention also discloses a localized heating system for heating a portion of water within larger water bodies, which provides a solution to achieve a comfortable temperature of the water for direct contact recreational purposes in a cost-efficient manner in a partially confined portion of water by keeping the concept of being in the same water body.

Contrary to the present invention, if a fully confined system was used to separate the portion of water that is heated through a physical barrier that completely divides the water body and creates a fully confined area, then the quality of such water body would be negatively affected or it would need to be an independent conventional swimming pool, and would not be a part nor hydraulically connected to the larger water body.

Therefore, the present invention at the same time solves the comfort issues by providing a localized heating system and method that increases the temperature of the water in a designated portion of water within larger water bodies, and at the same time provides a partial confinement system that allows for the exchange of water from the heated zone with the rest of the water body to allow for a dilution effect and minimizing stagnant areas of water.

The localized heating system from the present invention comprises a partial confinement barrier system (2) that can be installed within a natural or man-made water body (1). The partial confinement system (2) allows to create a partially confined zone (3) at a designated portion of the water body (1), where such designated portion of water is heated through a heating system (7) and where the partial confinement system (2) is configured to minimize heat transfer or heat loss between the heated area and the rest of the water body. The system of the present invention avoids having to construct a complete physical separation barrier to separate the heated zone from the non-heated zone, at the same time minimizing heat transfer between the partially confined portion of water and the rest of the water volume. The partial confinement system allows creating a heat plug and at the same time provides for a serpentine-style flow between both sides of the barrier, allowing to maintain the concept of being in the same water body.

Within the context of the present invention, complete physical separation denotes any means that completely or almost completely blocks the flow of water from one side to the other side of the physical separation means, and generally consists of a rigid or flexible barrier, generally configured upwardly from the bottom of the water body and attached to its edges and/or walls to achieve a practically complete confinement of such volume, notwithstanding there can be minor water losses from such volume. The system from the present invention allows to generate partially confined heated zones within larger water bodies at low costs by achieving a high efficiency of thermal confinement while at the same time allowing the water volume from inside the heated area to be hydraulically connected with the water volume within the water body but outside the heated area, and therefore achieves low energy requirements for heating the partially confined area.

It is also important to mention that the partial confinement system of the present invention includes barriers that are configured to provide a differentiated obstaculization of the water flow between both sides of the system, creating a heat plug and at the same time providing for serpentine-type flow between both sides. However, the partial confinement system from the present invention maintains the concept of being in the same water body and provides for an immersive experience for bathers and swimmers. Other types of hydraulic connections between a portion of water within larger water bodies and the rest of the water volume contained within such large water body such as the use of waterfalls, connecting piping, recirculating channels, or similar solutions may not allow achieving the concept of being in the same water body as in the present invention.

The barrier elements according to the invention, allow creating an hydraulic connection that is generally non invasive and does not significantly obstruct the visibility of the surface of the water from one side to the other. Thus, a person located within the partially confined area (either standing, swimming, or others) is able to see the surface of the water beyond the barrier, creating thus the immersive effect of being in a big body of water while only a specific portion of it is adapted for having a comfortable temperature, keeping thus the concept of being in the same water body.

Contrary to previous art disclosures, the system of the present invention comprises the use of at least two distinct barrier elements that are positioned in a relatively parallel configuration and at a certain special configuration, that surprisingly, has shown to minimize heat losses from the partially confined area and therefore requires less thermal load to achieve comfortable temperatures within such partially confined area, while at the same time provides for an hydraulic connection between the partially confined area and the rest of the water volume through a serpentine-type flow, to avoid water quality issues with totally confined (and potentially stagnant) water volumes.

The following table shows the main differences between the present invention and the previous art:

| Description | Present Invention | U.S. Pat. No. 3,922,732 | AT 411477B | EP 0771917B1 |
|---|---|---|---|---|
| Purpose | System for creating partially confined heated areas within larger water bodies | System and method for providing heated swimming pools | Floating swimming pool structure | System and method for heating an impounded volume within stagnant water bodies |
| Maintains the concept of being within the same water body | Yes-Providing an immersive experience | Not described nor mentioned | Not described nor mentioned | Not described nor mentioned |
| Use of at least two barrier elements | Yes | No-Only one floating element | No-Floating swimming pool with walls/bottom | No-Only one floating element |
| First Barrier element configuration | Positioned from the bottom in an upwards position | Not described | Not described | Not described |
| Second Barrier | Positioned from | Thermally insulated | The wall of the | Floating hollow |

-continued

| Description | Present Invention | U.S. Pat. No. 3,922,732 | AT 411477B | EP 0771917B1 |
|---|---|---|---|---|
| element configuration | the surface in a downwardly position | floating element | floating swimming pool | body with a skirt |
| Minimizes entry of cold water into partially confined area | Yes, through the use of the first barrier element positioned from the bottom upwards | Not described nor mentioned | Not described nor mentioned | Not described nor mentioned |
| Allows a heat plug effect | Yes | Not described nor mentioned | Not described nor mentioned | Not described nor mentioned |
| Generates serpentine flow of water between partially confined zone and rest of the water volume | Yes, given the configuration of the barriers | Not described nor mentioned | Not described nor mentioned | Not described nor mentioned |
| Provides for low thermal load requirements for achieving comfortable temperatures | Yes, as minimum heat loss is provided | No, the entry of cold water and mixing decreases the temperature of the water and therefore more thermal load is required. | — | No, the entry of cold water and mixing decreases the temperature of the water and therefore more thermal load is required. |
| Volume of water used for direct contact recreational purposes | Confined by the bottom of the water body and the partial confinement system | Open volume with no defined bottom. | Floating swimming pool volume | Open volume with no defined bottom. |

The partially confinement system is therefore a heat-loss barrier or "heat plug" that allows creating partially confined zones within a natural or man-made water body, allowing improved and comfortable temperature conditions for recreational activities, and therefore generating a revolution that allows direct contact recreational purposes such as swimming in natural and man-made bodies of water worldwide.

Heating of Large Water Bodies

Regarding heating of water bodies and heat dissipation and loss from water bodies, it is important to understand that in water bodies heat is lost by a variety of mechanisms. The energy balance of a water body can be seen in FIG. 1, where the heat gains/losses occur due to:

- $H_{ind}$: External heat flux source provided to the water body for heating purposes
- $Q_{ar}$: Heat flux absorbed from the atmosphere
- $Q_{sr}$: Solar radiation heat flux absorbed by the water body
- $Q_{prec}$: Heat flux resulting from precipitation (rain, snow, etc)
- $Q_C$: Heat flux resulting from water leakage
- LE: Heat flux resulting from evaporation
- $Q_{in}$: Heat flux resulting from make-up or other water flows discharged in the water body
- $Q_p$: Heat flux resulting from water purges
- $Q_b$: Heat flux resulting from black body radiation from the water body
- S: Sensible heat flux transferred between the air and the Surface of the water body Such heat fluxes from and into the water body will have an effect in its equilibrium temperature, where water bodies generally have a relatively homogeneous temperature horizontally, and where deeper zones have lower temperatures than shallower areas (given internal currents and mixing of the water at colder temperatures that is more dense and therefore tends to sink, and water at warmer temperatures that is less dense and tends to move upwardly into the water surface).

The present invention, in a rupturistic and innovative manner, provides a system for the partial confinement of a water body that creates a thermal barrier between two distinct areas within the water body, the system comprising at least two barrier elements, which are positioned in a relative position to each other that, surprisingly, has proven to be effective in containing water having a higher temperature without substantially disturbing the general appearance of the water body and achieving an immersive experience for swimmers and bathers, maintaining the concept of being in the same water body. The present invention further provides a localized heating system for creating partially confined heated zones within larger water bodies.

Figure 9:
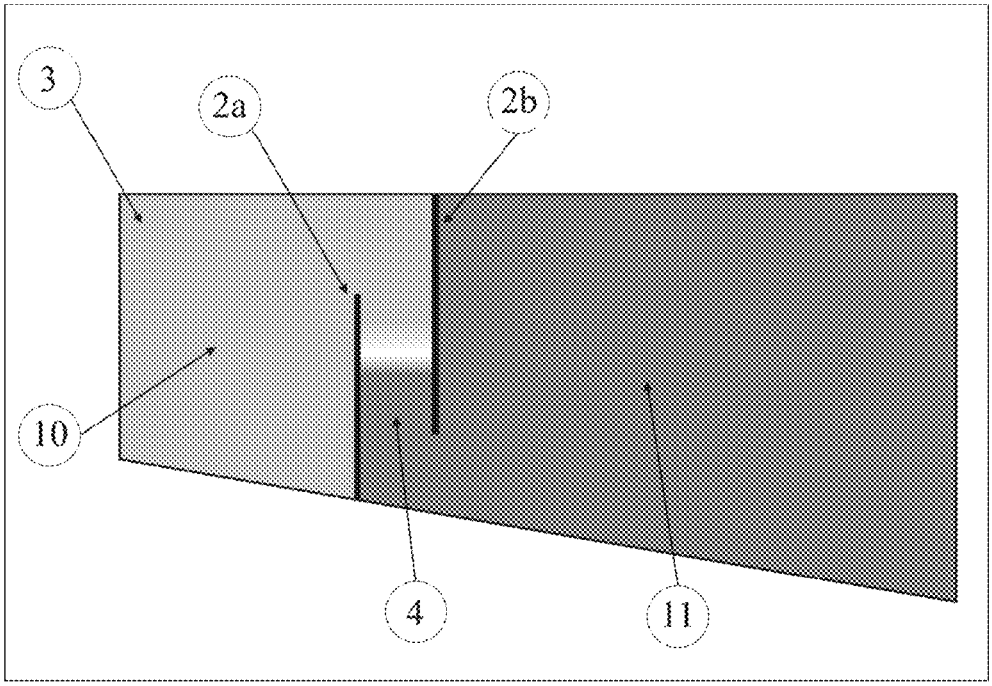
FIG. 9 shows a schematic side view of a water body (1) having a system for the partial confinement (2) of a portion of such water body, and depicting the temperature difference between the partial confinement zone (3) and the rest of the water volume (11). The heated water (10) within the partially confined area is shown with a lighter tonality than the colder temperatures of the rest of the water volume (11), and the transition zone (4) has a water mixture with a thermal gradient.

The system for the partial confinement (3) of a water body (1) according to the present invention comprises at least, a first barrier element "FBE" (2*a*) and a second barrier element "SBE" (2*b*) that are separated by a horizontal distance (HD) to create a transition zone (4) that allows to partially confine a portion of the water body (1), which can be heated through various means. The configuration of the barrier elements of the present invention allows heated water to substantially remain in the partially confined area (3) closer to the surface, while at the same time the colder water from the remaining portion of the water body is limited from entering the partially confined area (3), generating a differentiated obstaculization of the thermal load, as depicted by FIG. 9. This allows to create a thermal barrier or "heat plug", as the configuration of the first and second barrier elements allows to minimize heat loss from the partially confined area (3) to the rest of the water volume, while at the same time allows minimizing the inflow of colder water into the partially confined area (3) to achieve higher heating efficiencies and reduction of thermal load to achieve comfortable temperatures in such area, all of this while at the same time there is an hydraulic connection between the partially confined area (3) and the rest of the water volume.

Figure 4:
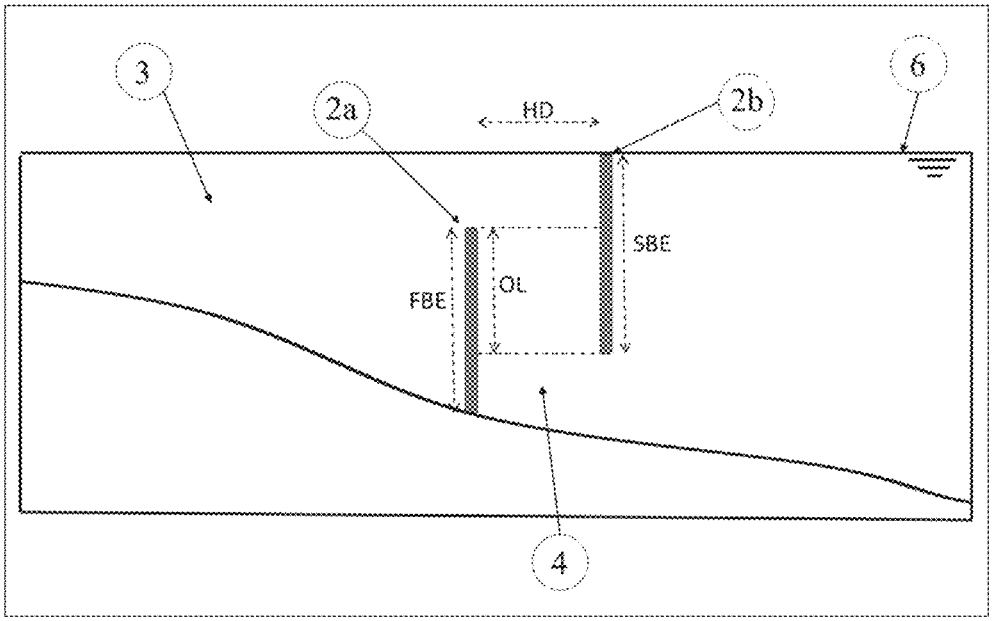
FIG. 4 shows an embodiment of the invention through a schematic side view of a water body having a system for the partial confinement (2) of a portion of water within such water body using a first and second barrier element (2*a*) and (2*b*), which shows the transition zone (4), and highlighting the Horizontal Distance (HD) and the Overlap Length (OL) based on the first and second barrier elements FBE and SBE shown as (2*a*) and (2*b*).

A schematic configuration of the first and second barrier elements can be seen in FIG. 4, and is such so that the first barrier element (2*a*) is closer to the partially confined area (3) and minimizes, and preferably avoids, entrance of cold water into the partially confined area (3) by being positioned from the bottom of the water body to achieve an upwardly position. The second barrier element (2*b*) is separated from the first barrier element (2*a*) by at least a minimum horizontal distance (HD) so as to create a transition zone (4) that houses a partially confined water volume between the first and second barrier elements.

Figure 8:
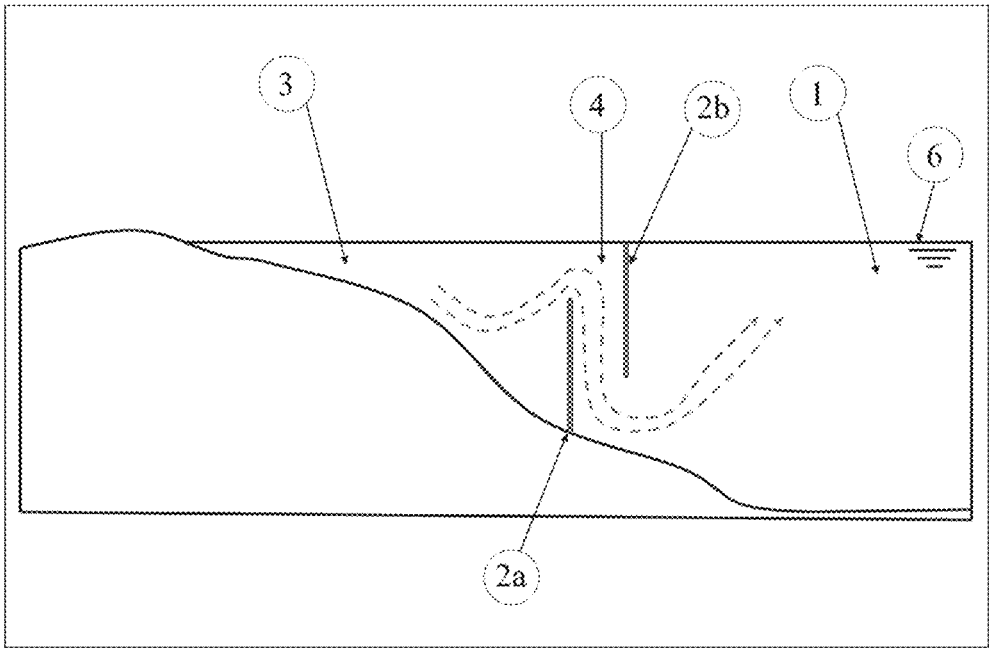
FIG. 8 shows a schematic side view of a water body (1) having a system for the partial confinement (2) of a portion of such water body, and highlighting the serpentine flow created by the system of the invention.

The partially confinement system of the present invention allows generating a flow current pattern between the partially confined zone and the rest of the water volume similar to a serpentine flow, passing above the first barrier element into the transition zone and then passing through the bottom of the second barrier element to reach the rest of the water volume, as it can be seen in FIG. 8. This serpentine flow between both the partially confined area and the rest of the water body allows the exchange of water in a controlled manner depending on the water balance of the water body and any water inflows and outflows from the partially confined zone (3) and the rest of the water volume.

FIG. 9 shows a side view of a simplified schematic configuration of the partial confinement system, the heated water (10) located within the partially confined area (3) is shown with a lighter tonality than the colder water (11) outside of the partially confined area which is shown in a darker tonality. As seen in FIG. 9, the configuration of the system allows to contain the heated water (10), where the second barrier element (2*b*) provides a physical limitation to contain such heated water and aims to avoid such heated water from leaving the transition area (4). At the same time, the first barrier element (2*a*) provides a physical limitation to contain the colder water (11) located close to the bottom and at deeper depths, and aims to avoid such colder water from entering the partially confined area (3).

The present invention discloses an innovative system that makes it possible to decrease the heat loss in a partially confined area within a water body by providing the aforementioned partial confinement system that acts as a "heat plug" and minimizes heat loss between the partially confined area and the rest of the water volume, while at the same time an hydraulically open system is provided where water flow from one area to the other is allowed through a serpentine-type flow, avoiding water quality issues associated with total confinement of such areas, among other issues.

The present invention therefore facilitates the practice of recreational activities of direct contact within large man-made or natural bodies of water and extends their usability throughout the year.

In the context of the present invention, direct contact recreational activities involve, but are not limited to, repeated or continuous direct contact of bathers with the water, such as swimming, diving, and wading by children, among others.

The system of the invention is a versatile system that can be adapted to different conditions, such as weather conditions, seasonal use, people's attendance, and/or events taking place within the large water body, among others.

The system for the partial confinement of a water body that creates a thermal barrier between two distinct areas within the water body from the present invention can be used for natural or man-made water bodies and creates partially confined zones (3) within the water bodies, where such system comprises at least:

A first barrier element FBE (2*a*) positioned from the bottom (4) of the water body (1) in a substantially upwardly position, wherein the first barrier element (2*a*) has a vertical length of up to about 95% of the water depth of the water body (1) where such first barrier element is positioned;

A second barrier element SBE (2*b*) positioned from the surface (6) of the water body (1) in a substantially downwardly position, where the second barrier element (2*b*) has a submerged depth of up to 95% of the water depth of the water body (1) where such second barrier element is positioned, The first and second barrier elements form an overlap length (OL), and the second barrier element (2*b*) is located at a horizontal distance (HD) from the first barrier element (2*a*), which creates a transition zone (4); and wherein the horizontal distance (HD) is greater than zero.

The large water bodies in which the principles of the present invention may be practiced, can be natural or man-made water bodies, and can have a surface area of at least 3,000 m2, preferably of at least 5,000 m2, more preferably at least 10,000 m2, even more preferably at least 30,000 m2 and most preferably at least 50,000 m2. The water bodies may even have very large surfaces, as for example the sea or large lakes.

The water bodies in which the principles of the present invention may be practiced have at least a bottom (5), and in certain embodiments, a wall, an edge and/or a side that surrounds the whole body of water (1), the area to be partially confined (3), or only the remaining portion of the body of water that is not heated. A wall according to the invention can be a wall having a substantially vertical position or a sloped wall, that allows containing the water within the water body. An edge according to the invention can be an irregular or regular sloped edge.

The system of the present invention is suitable to be used in natural water bodies like the sea, lakes, lagoons, reservoirs, estuaries, and/or ponds. Also, the system of the present invention is suitable to be used in man-made water features, such as high transparency man-made lagoons constructed with recent technologies.

The first barrier element (FBE) is configured and positioned from the bottom of the water body in a substantially upwardly position, so as to lower the amount of water that passes from one side to the other side of the FBE. In a preferred embodiment, the first barrier element (FBE) decreases the amount of heated water or water with higher temperature to pass from one side to the other side of the FBE. The FBE is also configured to be attached or affixed to the sides, walls, and/or edges of the water body to create an efficient bottom seal and optionally, wall and/or edge seal of such area. The FBE is substantially attached or affixed to the edges/walls and/or bottom of the water body across the whole perimeter of the FBE that is in contact with such edges and/or bottom as seen, for example, in FIG. 16. This allows to create an efficient seal of such contact perimeter to minimize water and heat loss through such contact perimeter. Preferably, the FBE is substantially sealed to the bottom of the water body so that there is no substantial flow of water between the FBE and the water at the bottom in the vicinity of the FBE. The FBE is affixed to the edges/walls and/or bottom of the water body through affixing means selected from the group comprising a fastener, a screw, a bolt, hinge, a joint, a weld, a seam, a webbing, an adhesive, a strip, a tape, and combinations thereof. The FBE may be affixed and/or anchored to the bottom through weights, or may also be embedded to the bottom.

The FBE (2*a*) has preferably a vertical length (VL) of up to 95% of the water depth of the water of the water body (1) where such first barrier element (2*a*) is positioned as depicted in FIG. 4. In other embodiments of the invention, the FBE (2*a*) has a vertical length of up to about 85%, about 75% or about 65% of the depth of the water body where such first barrier element (2*a*) is positioned. The vertical length of the FBE is therefore a length that depends on the actual water depth or level and not necessarily only on the fixed depth of the water body. In certain embodiments, when the water level changes either in a natural or man-made water body, the vertical length (VL) of the FBE (2*a*) may be adjusted to meet the technical parameter of being up to about 95%, 85%, 75% or 65% of the depth of the water of the water body where it is positioned. The FBE (2*a*) has a vertical length of preferably at least 20%, or at least 35% or at least 50% of the depth of the water of the water body where it is positioned. It is to be understood that such vertical length is indented to be maintained most of the time to achieve the efficiency of the present invention, however, there may be times given variations in water level, physical constrains or movements, or other effects that may cause such vertical length to not be within the predetermined ranges, but such small periods of time would not substantially affect the present invention and it is intended that the vertical length is restored to the predefined ranges to keep achieving the thermal efficiency of the method and system of the present invention.

Figure 6:
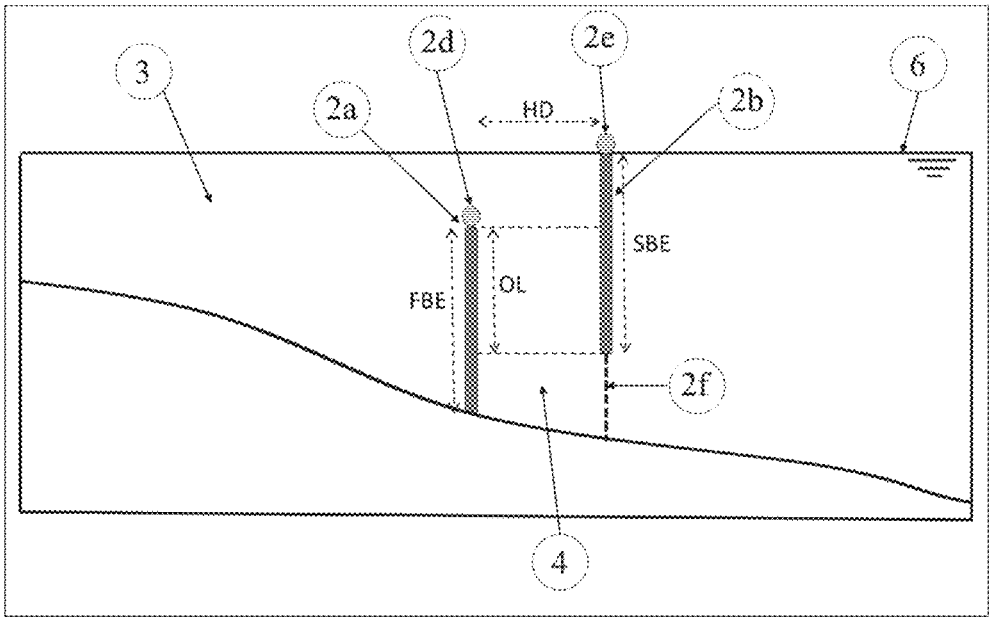
FIG. 6 shows an embodiment of the invention through a schematic side view of a water body (1) having a system for the partial confinement (2) of a portion of such water body, and highlighting the buoyancy means (2*d*) and (2*e*) and bottom anchoring means (2*f*).

The FBE (2*a*) may comprise buoyancy means (2*d*) in order to facilitate the FBE (2*a*) to maintain an upright position and to lower the influence of water currents that may push the FBE (2*a*) from one side to another, as seen in FIG. 6. Suitable buoyancy means are selected from the group comprising one or several buoys, a flotation line, conventional floating means and combinations thereof.

The FBE (2*a*) may comprise surface connecting means (2*c*) that connect the upper portion of the FBE (2*a*) to buoyancy means (2*d*) in order to facilitate the FBE (2*a*) to maintain an upright position and to lower the influence of water currents that may push the FBE (2*a*) from one side to another, wherein the connecting means do not exert a significant flow change. Surface connecting means (2*c*) for the FBE (2*a*) include a string, a cord, a spring, a snap line, rods, separators, a tether assembly and combinations thereof, which can be fixed to the upper portion of the FBE (2*a*) on one end and to buoyancy means (2*d*) on the other end, as seen on FIG. 7 Suitable buoyancy means are selected from the group comprising one or several buoys, a flotation line, conventional floating means and combinations thereof.

In another embodiment of the invention, the FBE (2*a*) may not be attached directly or indirectly to buoyancy means, but may be attached to the edges and/or walls of the water body or to elements outside the water body that help to maintain the vertical position of the FBE.

The buoyancy means of the FBE according to embodiments of the invention may also serve to act as a buoyancy line to indicate swimmers and bathers within the body of water the limit of the partially confined zone, the limit of the swimming and bathing zone, or as any delimiting line that is required. The buoyancy means can comprise overhead flags to increase the visibility of the barriers when needed.

The second barrier element (SBE) (2*b*) is configured and positioned from the surface of the water body in a substantially downward position so as to lower the amount of water that passes from one side to the other side of the SBE as seen in any of FIGS. 3 to 9. The second barrier element (SBE) preferably reduces the amount of cold water or water with lower temperature that may pass from one side to the other side of the SBE. The SBE is also configured to be attached or affixed to the sides, walls and/or edges of the water body to create an efficient seal of such area. The SBE is preferably substantially attached or affixed to the edges and/or walls of the water body in order to create an efficient seal of such contact area of the SBE with the edges and/or walls of the water body to minimize water and heat loss through such area. The SBE (2*b*) has a submerged depth (SD) of up to about 95% of the depth of the water body (1) where such second barrier element is positioned. In other embodiments of the invention, the SBE (2*b*) has a submerged depth of up to about 85%, 75% or 65% of the depth of the water body where such second barrier element (2*b*) is positioned. The FBE (2*a*) has a submerged depth (SD) of preferably at least 20%, or at least 35% or at least 50% of the depth of the water of the water body where it is positioned. It is to be understood that such submerged depth is intended to be maintained most of the time to achieve the efficiency of the present invention, however, there may be times given variations in water level, physical constrains or movements, or other effects that may cause such submerged depth to not be within the predetermined ranges, but such small periods of time would not substantially affect the present invention and it is intended that the submerged depth is restored to the predefined ranges to keep achieving the thermal efficiency of the method and system of the present invention.

Figure 7:
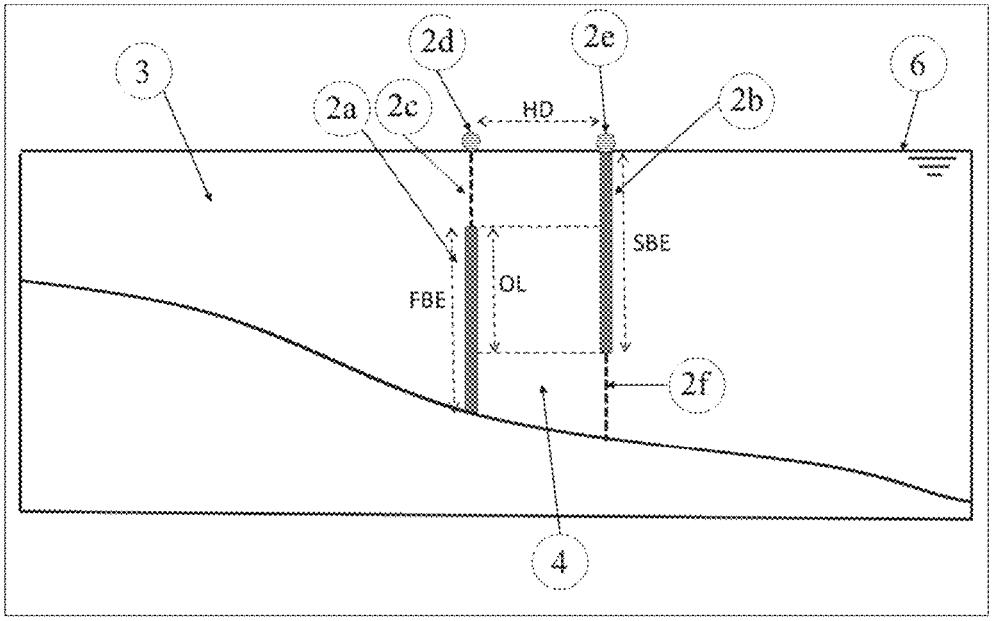
FIG. 7 shows an embodiment of the invention through a schematic side view of a water body (1) having a system for the partial confinement (2) of a portion of such water body, and highlighting the buoyancy means (2*d*) and (2*e*) and bottom anchoring means (2*f*) and surface connecting means (2*c*).

The second barrier element SBE (2*b*) may comprise buoyancy means (2*e*) affixed to its upper portion, wherein the buoyancy means (2*e*) are selected from the group comprising one or several buoys, a flotation line, conventional floating means and combinations thereof, as seen in any of FIG. 6 and FIG. 7. The buoyancy means of the SBE according to the invention serve as a means to maintain the SBE within its desired position as well as to act as a buoyancy line to potentially indicate swimmers and bathers within the body of water the limit of the partially confined zone, the limit of the swimming and bathing zone, or as any delimiting line that is required. The buoyancy means can comprise overhead flags to increase the visibility of the barriers when needed. The buoyancy means for the SBE may also act as an indicator of where the partial confinement system ends within the large water body. The buoyancy means for the SBE (2*e*) may be positioned either above the surface of the water, below the surface of the water or partially submerged.

On another embodiment of the invention, the SBE (2*b*) may not be attached to buoyancy means, but may be attached to the edges and/or walls of the water body or to elements outside the water body that help to maintain the position of the SBE.

Figure 16:
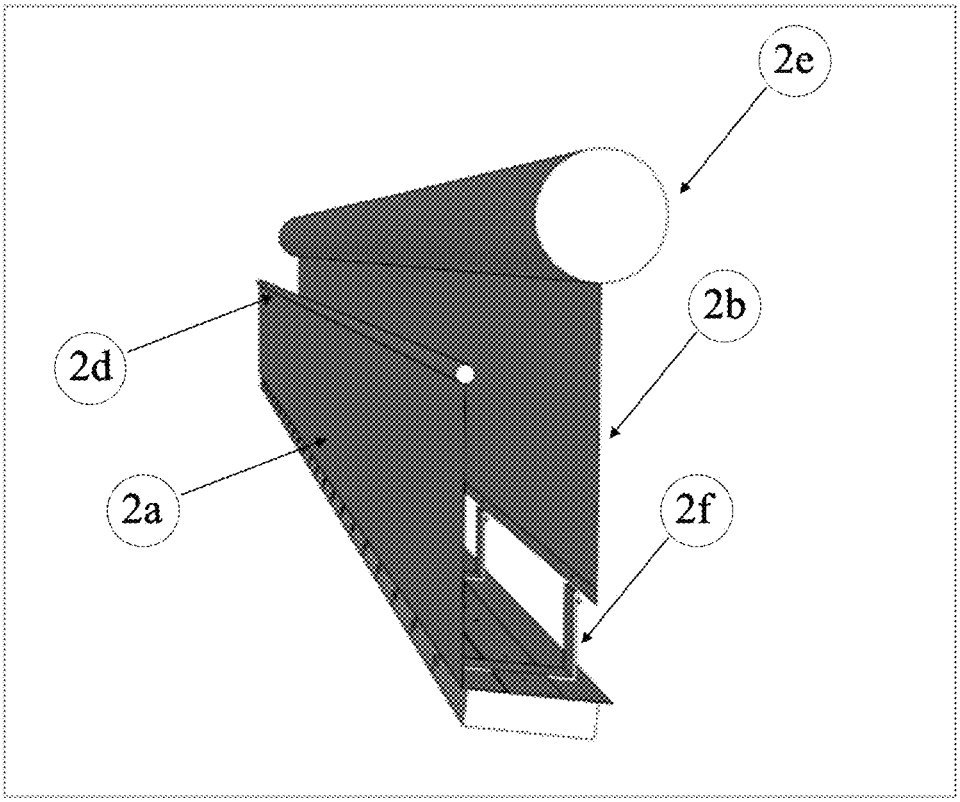
FIG. 16 shows an embodiment of the invention through a schematic side of the partial confinement system (2) according to the invention, including the buoyancy means (2*d*) and (2*e*) and bottom anchoring means (2*f*).

The second barrier element SBE (2*b*) can comprise bottom anchoring means (2*f*) that anchor the second barrier element SBE (2*b*) to the bottom of the water body without exerting a significant flow change, as seen in FIG. 7 and FIG. 16. Suitable bottom anchoring means (2*f*) include a tether assembly, a string, a cord, a chain, a pole, a spring, a snap line, rods, separators, netting materials, and combinations thereof, which can be fixed to the bottom of the water body by means through a fixed support, a dock or combinations thereof. The SBE may also be fully or partially embedded to the bottom, and may include materials and elements with perforations to facilitate the flow of water through the SBE or under the SBE (2*d*).

The FBE and SBE preferably comprise, or are made of, materials that allow the confinement of water that is in contact with said FBE and SBE. Preferably, FBE and SBE are made of any suitable material having a density close to that of the water in the water body to be partially confined. Preferably, FBE and SBE are comprised of a material that is resistant to degradation and/or destruction by exposure to daylight (UV rays), heat and chemicals. Materials from which the FBE and SBE may be constructed include, but are not limited to, light weight materials having either a hollow or filled interior, and preferably a weight located inside and/or outside of the hollow or filled interior in a position to facilitate maintaining the elements in an upright orientation in the water, and, preferably a coupling element at opposite ends allowing adjacent barrier elements to be connected end-to-end.

Materials from which the FBE and SBE may be constructed include Polyethylene Terephthalate, High-Density Polyethylene, Polyvinyl Chloride, Polyvinyl Chloride, Polypropylene, Polystyrene and mixtures thereof. Alternative materials include thermoplastics, such as Polypropylene, Thermoplastic Polyolefin (TPO), Fiberglass, Foam, Polymers, and/or combinations thereof. Optionally, the FBE and SBE are UV-stabilized and in yet another optional embodiment, the FBE and SBE may be covered with a UV-resistant coating. The materials used in the fabrication of the FBE and SBE shall not generate toxic conditions that may result in risk to potential bathers.

The FBE and/or SBE may be constructed with materials that provide flexibility to such barrier elements, or may be constructed of materials that generate a non-flexible material such as sheets that maintain their shape as they are submerged in the water body. In certain embodiments, the FBE and SBE may also be constructed using heavier weight or density materials, such as concrete, cement or combinations thereof.

The materials can, but do not necessarily need to have insulating properties, due to the thermal barrier according to the present invention is created by the provision of a transition zone instead by the insulating characteristics of the materials from which the barrier elements are constructed of.

In areas of the water body where no wall/edge/side exists, but only an irregular bottom of the water body is present, the length and the position of both the FBE (2*a*) and SBE (2*b*) can be adjusted to meet the parameters herein mentioned.

When positioned within the water body, the first and second barrier elements form an overlap length (OL), as depicted on FIG. 4. The overlap length (OL) is not necessarily a fixed length, since it may change due to the water level, different bottom surfaces and other factors that may slightly change the overlap length even if the length of the FBE and SBE remain unchanged. Any variation in the overlap length due to these and other factors, is understood to be within the definition of an overlap length (OL) according to the present invention.

As depicted in FIG. 4, FIG. 6 and FIG. 7, the second barrier element (2*b*) is positioned at a horizontal distance (HD) from the first barrier element (2*a*) that creates a transition zone (4) that allows to partially confine water, preferably heated water and therefore minimize heat loss. The horizontal distance (HD) is not necessarily a fixed distance and can change depending on many factors, such as the nature of the bottom of the water body, the natural or adjusted temperature of the water, the influence of water currents and waves, changes in the water tide or water level, and the dimensions of the zone to be partially confined. Any variation in the horizontal distance (HD) due to these and other factors, is understood to be within the definition of an horizontal distance (HD) according to the present invention The horizontal distance (HD) is always greater than zero in order to achieve a partial confinement effect instead of a complete physical separation of the two zones. The horizontal distance (HD) is preferably a distance that is sufficient to create a transition zone. Preferably, the horizontal distance (HD) is equal to, or lower than the overlap length (OL) between the first and second barrier elements such that a ratio of horizontal distance (HD) to overlap length (OL) of at least 1:1 is created. Other ratios falling within the scope of the invention are at least about 2:3, at least about 4:5, at least about 1:3 and at least about 1:2. Ratios falling within about 1:1 and about 1:4 are preferred.

Both the horizontal distance (HD) and the overlap length (OL) are expressed as an average since their position given the influence of water tides and currents, may be slightly affected. Preferably, the horizontal distance (HD) and the overlap length (OL) are expressed as an 24-hour average.

Figure 3:
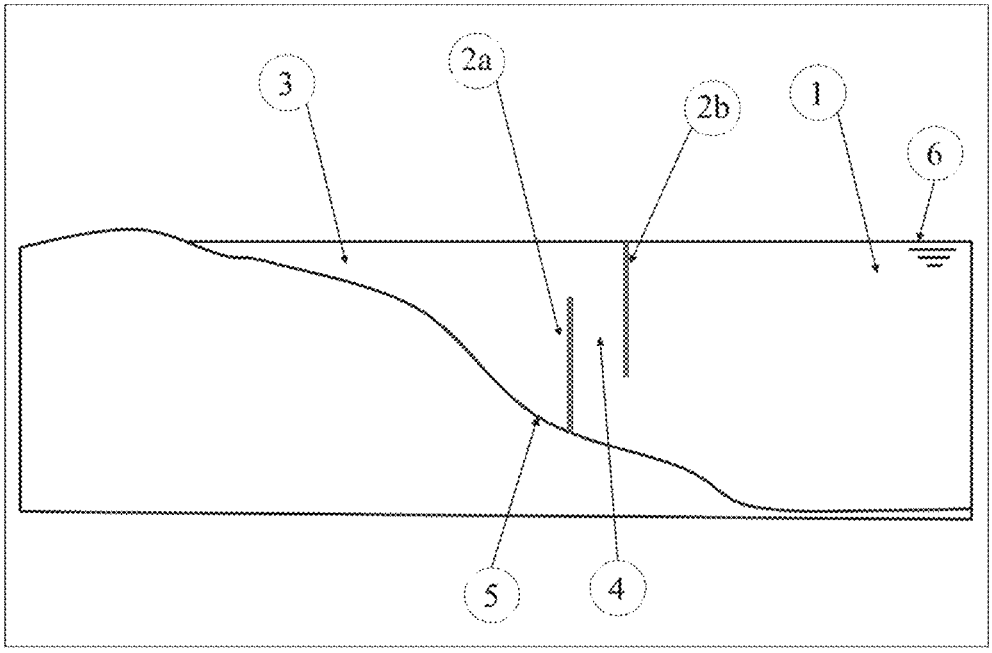
FIG. 3 shows a schematic side view of a water body (1) having a system for the partial confinement (2) of a portion of water within such water body (1), which creates a partially confined area (3) through first and second barrier elements (2*a*) and (2*b*) and the transition zone (4) contained within the first and second barrier elements (2*a*) and (2*b*), showing also the bottom of the water body (5) and the surface of the water body (6).

The horizontal distance (HD) may be at least about 20 cm and preferably at least about 35 cm and more preferably at least, or about 40 cm from the first barrier element (2*a*) and wherein the overlap length (OL) is at least about 20 cm and preferably at least about 35 cm and more preferably at least, or about 40 cm. This allows to thermally confine the heated water and generate a "heat plug" while still providing an hydraulic connection on both sides of the water body. The first and second barrier elements may be configured as shown in FIG. 3 and FIG. 4.

Figure 5:
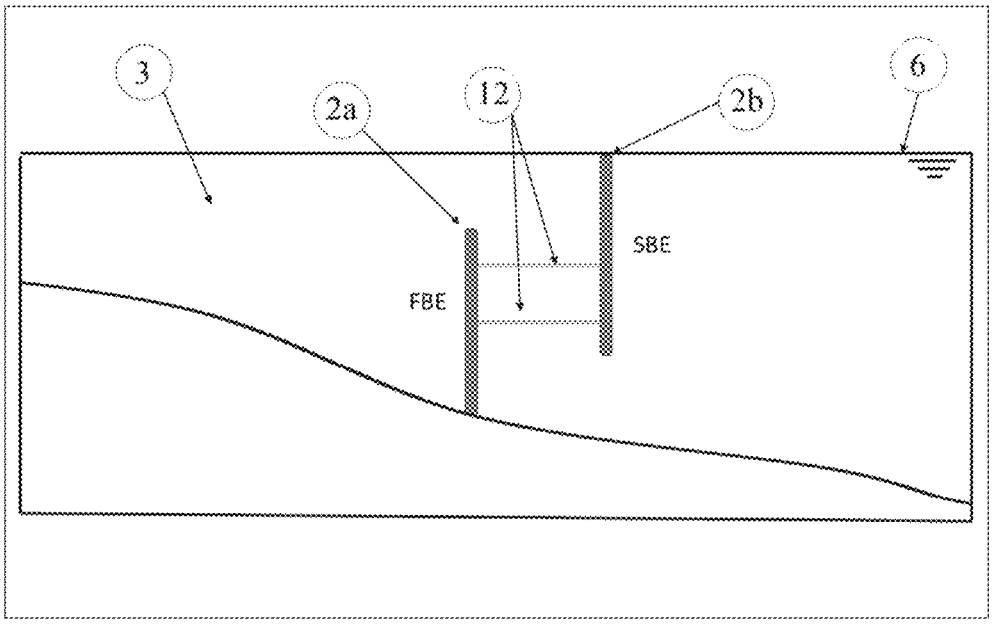
FIG. 5 shows an embodiment of the invention through a schematic side view of a water body (1) having a system for the partial confinement (2) of a portion of water within such water body, and highlighting an embodiment of connecting means (12) between the first and second barrier elements (2*a*) and (2*b*).

The system for the partial confinement of a water body that creates a thermal barrier between two distinct areas within the water body of the invention can incorporate at least one connecting means (12) that connect the FBE and the SBE with each other in order to lower variations in the horizontal distance (HD), as seen on FIG. 5. The connecting means (12) preferably connects the two barrier elements and does not exert a significant flow change within the transition zone. Several means can be used as connecting means but they are preferably selected from the group comprising a string, a cord, a spring, a snap line, a chain, a pole, rods, separators, and combinations thereof. The connecting means (12) can be positioned throughout at least one point, or several points along the at least two barriers, as seen on FIG. 5. In other embodiments of the invention, the bottom affixing means or means to affix the at least one of the barrier elements has a elements to maintain the minimize variations in the Horizontal Distance (HD).

Figure 10:
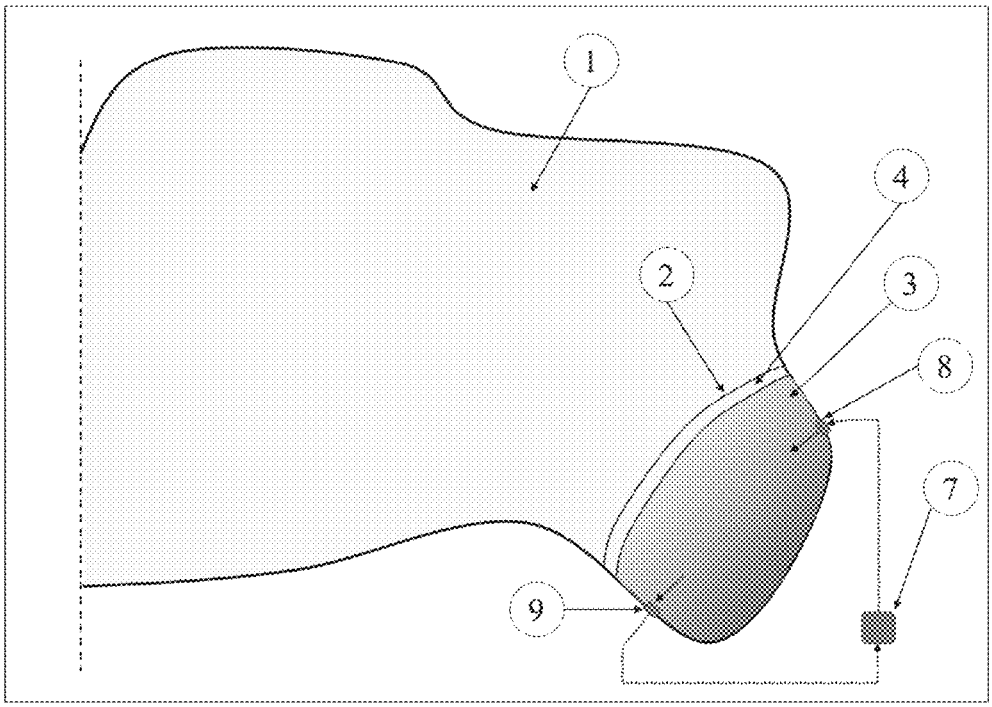
FIG. 10 shows an embodiment of the invention through a schematic overview of a water body (1) where a partial confinement system (2) according to the invention is implemented, and a heating system (7) is used to provide heated water to such partially confined area (3), wherein the water body has at least one heated water discharge point (8) and a water withdrawal point (9).

The system for the partial confinement of a water body that creates a thermal barrier between two distinct areas within the water body, when implemented in a water body, allows for providing a localized heating system, as seen on FIG. 10.

The localized heating system of the present invention may include at least one water intake point (9) preferably positioned within the water body, and more preferably within the partially confined zone, as depicted in FIG. 10, which shows the localized heating system of the invention. The at least one water intake point (9) is configured to withdraw water from the partially confined zone (3), where such water flow is withdrawn and sent into at least one heating system (7) that increases the temperature of the water flow, preferably the temperature is increased in at least about 1° C., or at least about 3° C. The heated water flow is then returned to the partially confined zone (3) through at least one heated water discharge point (8).

The heating system (7) may comprise at least a heating equipment, such as a heat pump or a gas heater, to increase the temperature of the water flow before discharging such heated water into the partially confined zone.

A heat exchanger may be provided, which allows heating the water flow with an external energy source to increase its temperature before discharging such heated water flow into the partially confined area. The heating system therefore may include a heat exchanger with a heating equipment that uses energy from an oil, electricity, gas or other carbon energy source, and more preferably from a renewable energy source (7*b*), such as a solar plant, waste heat from a power plant or any industrial process, a wind power station, and combinations thereof as seen on FIG. 12.

Figure 12:
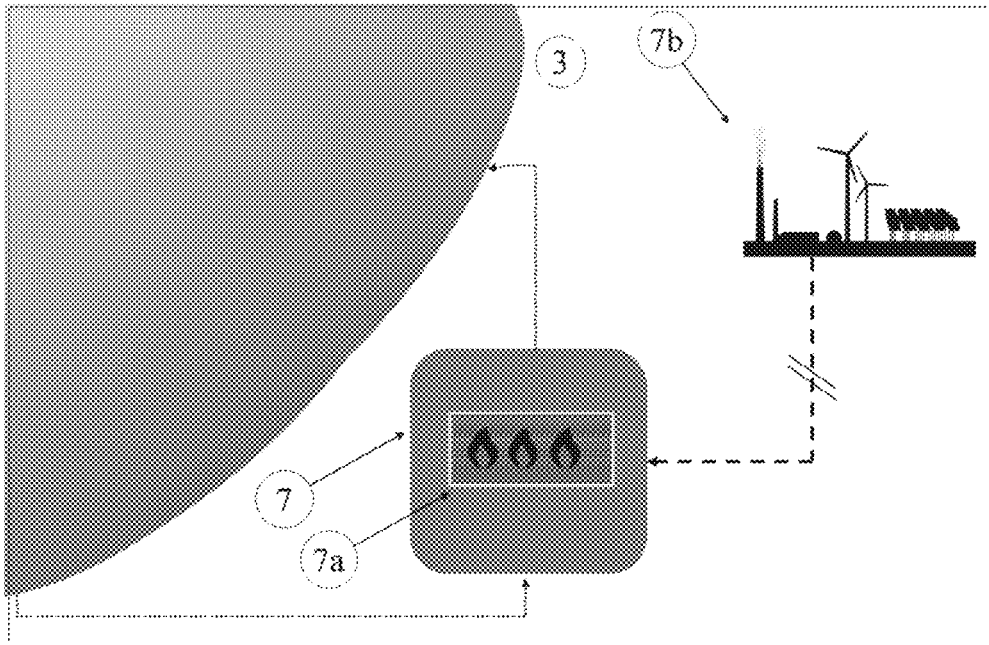
FIG. 12 shows an embodiment of the invention through a schematic overview of a water body (1) where a partial confinement system (2) according to the invention is implemented, and a heating system (7), wherein the heating source (7*a*) is connected to an external heating source (7*b*).

The heating system may also comprise a heat exchanger that allows heating the water flow with residual thermal energy from industrial and/or commercial facilities as seen on FIG. 12.

The heating system of the invention may comprise a heat exchanger and heating equipment as depicted in FIG. 12, wherein an enlarged view of the heating system is shown. This embodiment can be applied to any of the other embodiments described herein and does not denote a limitation to only those elements depicted in FIG. 12.

Figure 11:
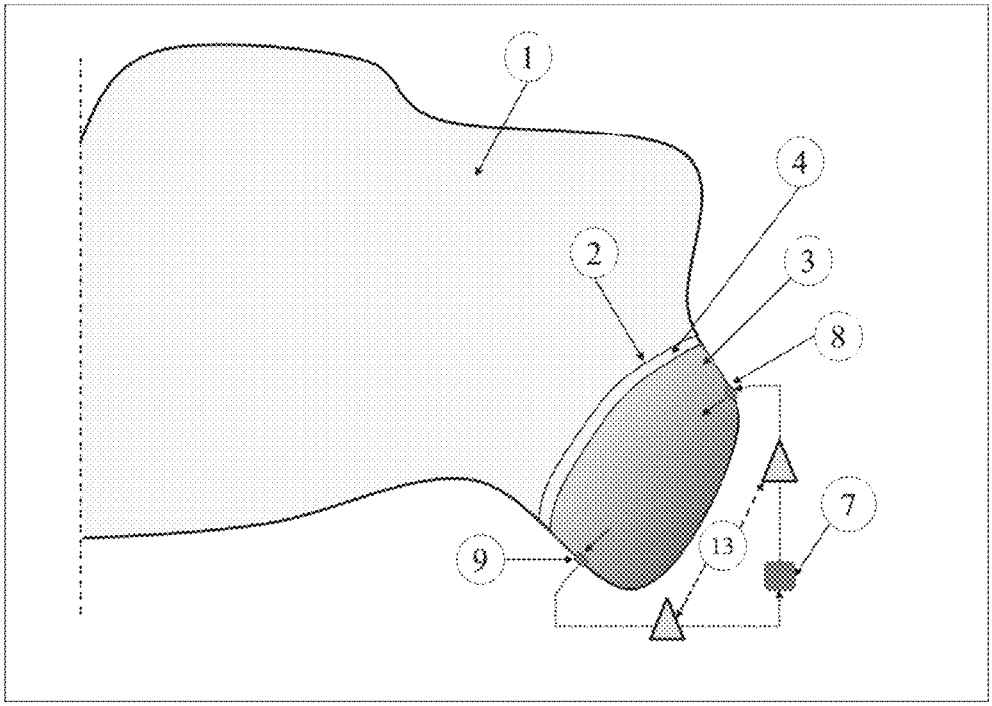
FIG. 11 shows an embodiment of the invention through a schematic overview of a water body (1) where a partial confinement system (2) according to the invention is implemented, and a heating system (7) is used to provide heated water to such partially confined area (3), having additional disinfection points (13).

The water withdrawn from the partially confined zone (3) can pass either before or after the heating system through a disinfection point (13), where an effective amount of chemicals is added, in order to increase the disinfection levels within the partially confined zone (3), as depicted in FIG. 11.

The heating system (7) of the invention may receive water that is withdrawn from the partially confined zone and may receive either fresh, treated and/or heated water from other sources.

The water withdrawn from the partially confined zone may not be sent to the heating system but instead discharged or used for other purposes. This configuration may be used in case of a contamination event occurring within the partially confined zone that would require the influx of fresh water to facilitate the prompt dilution of the contamination within the partially confined zone.

The at least one edge portion of the water body where the localized heating system may be positioned generally comprises a downward slope from the edge periphery to the bottom at an average angle $\alpha$ that results in a slope of up to about 15%, preferably of up to about 30%. This configuration allows achieving a safe and easy entry of bathers and swimmers into the water body, where such sloped area is partially confined to provide a higher temperature than in the rest of the water volume.

The first and second barrier elements may be attached or affixed to at least the bottom, a vertical wall, a sloped wall and/or to the edge of the water body in a zone where a slope of between 0% and 30% is present. Preferably, the bottom of the partially confined zone (3) sits in average, at a higher elevation than the bottom of the rest of the body of water or than the area of the water body that contains water with a colder temperature.

The first and second barrier elements are preferably positioned within the water body at a distance from the edge or from a wall of the water body that allows creating an area that allows the practicing of recreational bathing and swimming Preferably, the first and second barrier elements are positioned within the water body at a distance of at least five meters from the edge of the water body that transitions into the water body. In this embodiment, the invention requires that at least a minimum distance of five meters between a portion of the edge and the first and second barrier elements is created, which allows providing a suitable area for recreational purposes. There is no set maximum distance required, provided that the relative position between the at least two barrier elements is substantially maintained.

The first and second barrier elements are positioned within the water body so that the partially confined area has a volume of at least about 200 $m^3$ or at least about 500 $m^3$, or at least about 1,000 $m^3$ or more.

Figure 13:
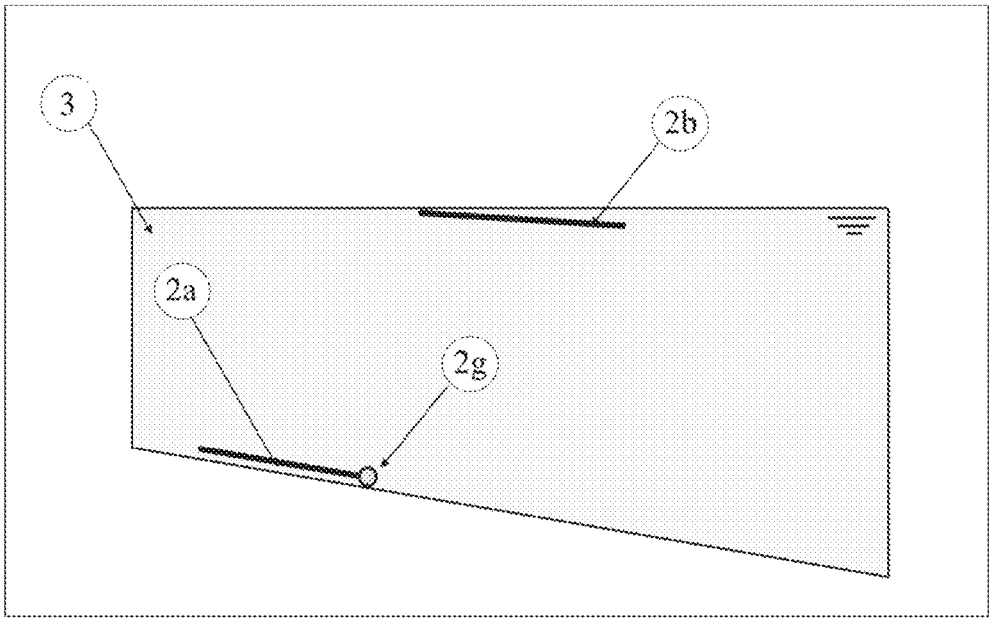
FIG. 13 illustrates a schematic side view of a water body (1) having a system for the partial confinement (2) of a portion of such water body, and depicting an embodiment where the two barrier elements (2*a*) and (2*b*) are retracted.

The first and second barrier elements according to the present invention can comprise means to retract and maintain the barriers in a substantially horizontal position or in a position that does not exert any effect in the flow of water as seen in FIG. 13. Retracting means may be implemented when there is no requirement to provide a higher temperature within the partially confined zone or in the case of a contamination event taking place in that zone, in order to facilitate the dilution of said contamination to the rest of the water body. In this embodiment, the lower end of the FBE may be affixed to the bottom of the water body through suitable bottom affixing means (2*g*) that allow the FBE to be placed in a substantially horizontal position or in a position that does not exert any substantial effect in the flow of water. Suitable bottom affixing means (2*g*) include affixing means with a hinge mechanism that allow maintaining said substantially horizontal or parallel position to the bottom of the water body. In this same embodiment, the SBE may not be connected to the bottom of the water body through bottom anchoring means and instead is allowed to float on the water body in a substantially parallel position to the surface of the water body.

Regulatory Considerations

In addition to considering the heat transfer mechanisms to achieve a partially confined area, it is important to understand that the intent of not having a fully confined area also has sanitary and regulatory purposes.

Regulations throughout the world generally require that large water bodies that are used for recreational purposes of direct contact, should follow certain standards and comply with quality requirements in order to make sure that the water is safe for such purposes.

As a comparison, conventional swimming pool treatment technology is generally used in small (generally smaller than 1,250 m2 of water surface, which is the equivalent to an Olympic swimming pool) and totally confined water bodies with specific characteristics and usually built out of concrete with plain, regular, and firm bottoms. Since swimming pools have low sizes, generally their regulations worldwide require filtering the complete water body between one to six times per day, preferably at least four times, as well as to maintain a permanent concentration of a disinfectant in the complete volume of water to maintain a suitable water quality for recreational purposes.

Therefore, if conventional swimming pool treatment and construction technology was used for the purposes of the present invention, a completely confined and independent water volume would be required, whereas the system of the present invention avoids having to separate both water volumes and allows having an hydraulic connection between the heated zone and the rest of the water body, with minimal heat loss to require low thermal loads for achieving comfortable bathing temperatures of the water within the partially confined area.

Therefore, the present invention allows to generate a heated partially confined portion of water within a larger water body by providing a localized heating system and method that increases the temperature of the water in a designated portion of water within larger water bodies, and at the same time provides a partial confinement system that allows for the exchange of water from the heated zone with the rest of the water body to allow for a dilution effect and minimizing stagnant areas of water. The partial confinement system, in an innovative manner, allows creating a heat plug and at the same time provides for a serpentine-style flow between both sides of the barrier, allowing to maintain the concept of being in the same water body. Further, the partial confinement system of the present invention includes barriers that are configured to provide a differentiated obstaculization of the water flow between both sides of the system, creating a heat plug and at the same time providing for serpentine-type flow between both sides.

Example I

The system for the partial confinement of a water body that creates a thermal barrier between two distinct areas within the water body of the present invention was implemented in a body of water having a surface of about 32 $m^2$ and a volume of about 48 $m^3$ in the South of Chile.

A partial confinement zone was created, having a surface of about 8 $m^2$. A first barrier element FBE was positioned in an upwardly position at distance of about 2 meters in average from the existent vertical wall, and a second barrier element SBE was positioned at a farther distance from the wall. The FBE was affixed to the bottom and walls of the water body and was sealed thereto in order to minimize the passage of water through the affixed areas. The SBE was positioned in an upwardly position and was affixed and sealed to the sides of the swimming pool in a similar position as seen in referential FIG. 9. A floating line was affixed to the upper side of the SBE covering the width of the body of water. The relative position of the SBE and the FBE created a horizontal distance (HD) of about 40 centimeters and an overlap length (OL) of about 40 centimeters, being therefore in the ratio of about 1:1.

Water from the partially confined zone having an initial average temperature of 18 degrees Celsius was extracted from an outlet line located at about 80 cm below the water surface, and sent to a heating system comprising an internal heat exchanger, which increased temperature of the extracted water to 43° C., with a temperature increase of about 25° C. The water flow was in the range of 1.8 m3/h. The heated water was returned to the partially confined zone through an inlet line, at about 100 cm below the water surface level.

Figure 14:
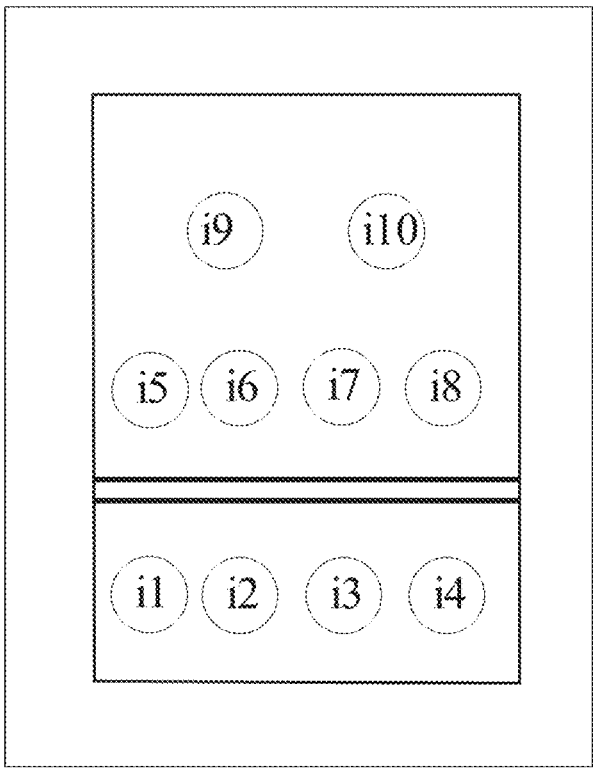
FIG. 14 shows a referential drawing of a swimming pool according to Example I and the referential location of sensors i1 to i10 within the swimming pool, as well as the location of the partially confined area (3) and the partial confinement system (2).

Water temperature measurements were made every 5 minutes in four different points of the partially confined zone (depicted as i1-i4 in FIG. 14, corresponding to a schematic configuration of the temperature sensors used during the testing period) and in six different points of the area of the body of water beyond the SBE (depicted as i5-i10 in FIG. 14, corresponding to a schematic configuration of the temperature sensors used during the testing period).

Figure 15:
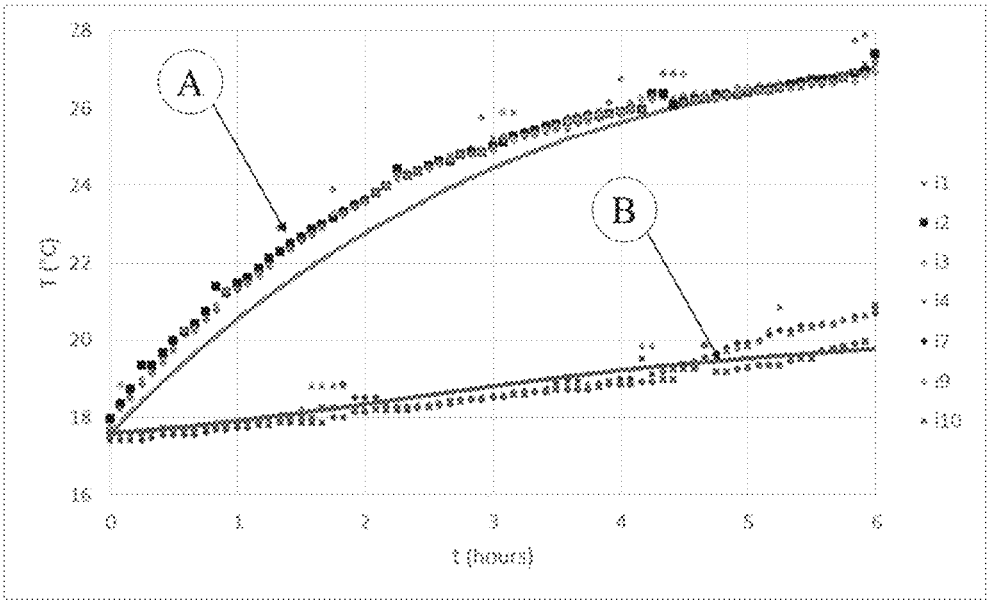
FIG. 15 shows the temperature measurements made according to Example I.

The temperature variation within the partially confined zone and the rest of the swimming pool was compared during an interval of six hours. As seen in FIG. 15, the average temperature of the water within the partially confined zone (line A) shows a steady increase to a temperature of up to about 27.2° C. after six hours, whereas the average temperature of the water beyond the SBE generally maintained its temperature and only mildly increased up to about 20° C.

The estimated mass flow rate of water moving away from the partially confined zone into the rest of the water body was 8 liters per minute per meter of barrier.

The system of the invention allowed achieving an average temperature difference of at least 8 degrees within the partially confined zone versus the rest of the swimming pool, requiring an energy spent of 201.6 kWh for a 6-hr period of water heating. In comparison, if the complete water volume would require to be heated for the same water volume and for the same time and up to the same temperature, the amount of energy would be of about 621.6 kWh (to achieve the same temperature). In this small scale example, the system achieves a 68% reduction in energy consumption to create a partially confined zone with comfortable temperatures compared as heating the complete water volume.

Example II

The system of the present invention has been evaluated to be incorporated into a 16,000 $m^2$ man-made lagoon located in Colina, Chile and the related data is provided in the following prophetic example.

The zone to be partially confined has a surface of about 600 $m^2$ and is located in one portion of the edge of the man-made lagoon, that edge having a zero-entry type forming a downward slope of about 10% until a depth of about 1.4 meters.

Simulations have been performed to estimate the required thermal load and energy to provide a constant 28° C. year round in the complete lagoon water volume, which have resulted in 11.355 MW in required maximum thermal load and 24,632 MWh of energy use, respectively.

On the other hand, using the system from the present invention, to achieve a relatively permanent temperature of 28° C. year round in the aforementioned 600 m2 of a partially confined zone with a mass flow rate of about 8 l/min/m (as found in Example I), the thermal load and energy result in 904 KW and 2,977 MWh, respectively, up to 88% less energy than for heating the complete water volume.

Further, circulation studies have shown that the partial confinement system allows a serpentine flow exchange of water between the partially confined zone and the rest of the lagoon water volume, allowing to maintain homogeneity of such water volume and providing dilution power to the partially confined zone.

While the invention has been particularly shown and described with reference to preferred embodiments thereof, it will be understood by those skilled in the art that various other changes in the form and details may be made therein without departing form the spirit and scope of the invention.

By using the partial confinement system and localized heating system from the present invention, important energy savings are achieved while still allowing comfortable temperatures for direct contact purposes for bathers in a partially confined zone of the water body Example III The system for the partial confinement of a water body was implemented in a 16,000 $m^2$ man-made lagoon located in Colina, Chile.

Figure 17:
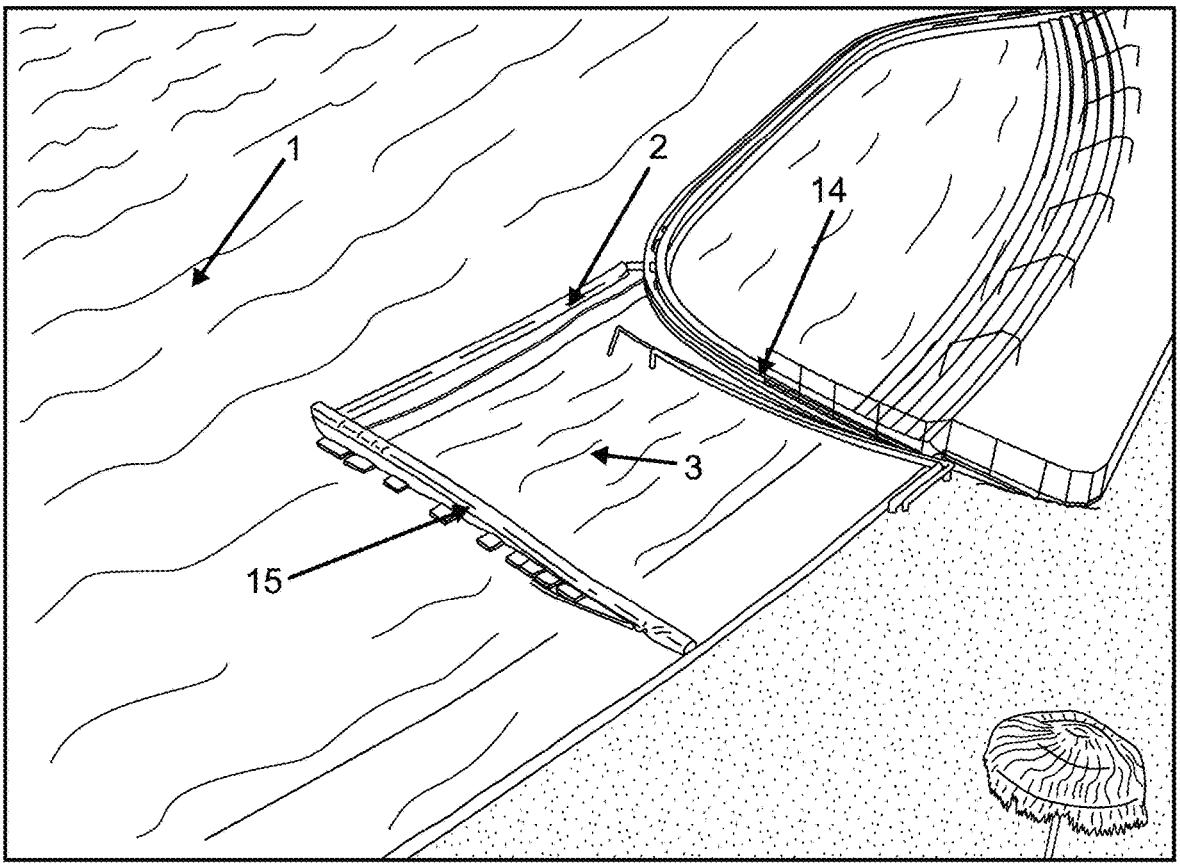
FIG. 17 depicts an aerial photo of referential Example III, showing the location of the partial confinement system (2), the partially confined area (3) within the water body (1), the side walls (14) and (15).

The zone that is partially confined has a surface of about 85 $m^2$, a volume of about 55 $m^3$, and length of about 10 m from wall to wall, and is located in one portion of the edge of the man-made lagoon, that edge having a zero-entry type forming a slope of about 10% into the water body. The partially confined zone was created with the use of two vertical walls on its sides, where one of the side vertical walls was the wall of a perimetral swimming pool located within the man-made lagoon (which has a separate and independent water volume), such wall depicted as element (14) in FIG. 17, and the wall on the other side was temporary and was designed, built, and placed into the man-made lagoon in order to generate a second side wall for the partially confined zone in order to easily measure the performance and efficiency of the localized heating within the partially confined area, the second side wall depicted as element (15) in FIG. 17. FIG. 17 shows the above elements, as well as the location of the partial confinement system (2).

The partially confinement system included a first barrier element (FBE) that was located closer to the edge of the man-made lagoon, at a distance of about 12 meters from the edge of the man-made lagoon, and which was positioned from the bottom in a substantially upwardly position. Such distance from the edge of the man-made lagoon was maintained most of the time, considering variations that ocurr given water level changes, wind, internal currents, or other effects. The FBE was built out of a clear PVC fabric of about 1 mm, and on its top area included buoyancy means (2*d*) corresponding to a cylinder of 5 cm of diameter built out of 20-kg/m3 expanded polystyrene. Such cylinder provided the required buoyancy so that the FBE maintained a substantially upward position most of the time. The FBE also included a bottom anchoring means comprising a plate and weight as seen in FIG. 16, which allowed to maintain the FBE closer to the bottom of the man-made water body to minimize any water flow from passing under the FBE into the other side. The area where the FBE was installed has an average depth of about 1.05 meters, and the length of the FBE was about 0.85 meters, which corresponds to about 81% of the man-made lagoon's water depth at that area.

The partially confinement system also included a second barrier element (SBE) that was positioned behind the FBE further away from the partially confined area, and was located at a distance of about 12.5 meters from the man-made lagoon's water edge. Such distance from the edge of the man-made lagoon was maintained most of the time, considering variations that ocurr given water level changes, wind, internal currents, or other effects. Therefore, the horizontal distance (HD) between the FBE and the SBE was about 50 cm, and was maintained most of the time, considering variations that ocurr given water level changes, wind, internal currents, or other effects that may affect such HD at given times and generated a range of within 35 cm to 50 cm of HD. The SBE was built out of clear PVC fabric of 1 mm and on its top area it included a buoyancy means corresponding to a cylinder of 35 cm of diameter built out of 20-kg/m3 expanded polystyrene. Such cylinder provided the required buoyancy so that the SBE floats on the surface of the lagoon, and at the same time the diameter was chosen to avoid passing of water from outside of the partially confined area or transition area due to wind effects, waves, currents, or others, which could affect the system's thermal efficiency. The SBE was anchored to the bottom of the man-made lagoon through u-shaped elements that were attached to the bottom as seen in FIG. 16 as element (2*f*). Such anchoring elements allowed to maintain the position of the SBE substantially upward as well as minimizing horizontal movement of such SBE. The area where the SBE was installed has an average depth of about 1.1 meters, and the submerged depth of the SBE was about 0.85 meters, which corresponds to about 77% of the man-made lagoon's water depth at that area. The overlap length was about 60 cm, which was maintained most of the time, although there are effects that can affect such length such as wind, currents, bathers, among others. The space between the FBE and the SBE allowed creating a transition zone having thus a ratio of horizontal distance (HD) to overlap length (OL) of about 5:6.

In order to achieve an intended average temperature in the partially confined area of about 28° C., a design thermal load of 215 kW was used to determine and size the heating system and heating equipment. The design thermal load was achieved by the use of two aerothermal electric heat pumps model Dunner 50, each with 48 kW of thermal power, and a gas heater model Rheem M406 with 119 kW of thermal power. Such equipment was part of the heating system.

The design water flow to be withdrawn and discharged into the partially confined area was determined to be 33 m3/h, which was withdrawn from the partially confined area using a 140 mm diameter pipe, and such water flow was then sent to the heating system in order to increase its temperature. After the water passed through the heating system (not shown in the Figures), the heated water was returned through a 110 mm pipe into the partially confined area, through a manifold with 6 inlets of 20 mm each, in order to homogeneously distribute the heated water into the partially confined area.

Figure 18:
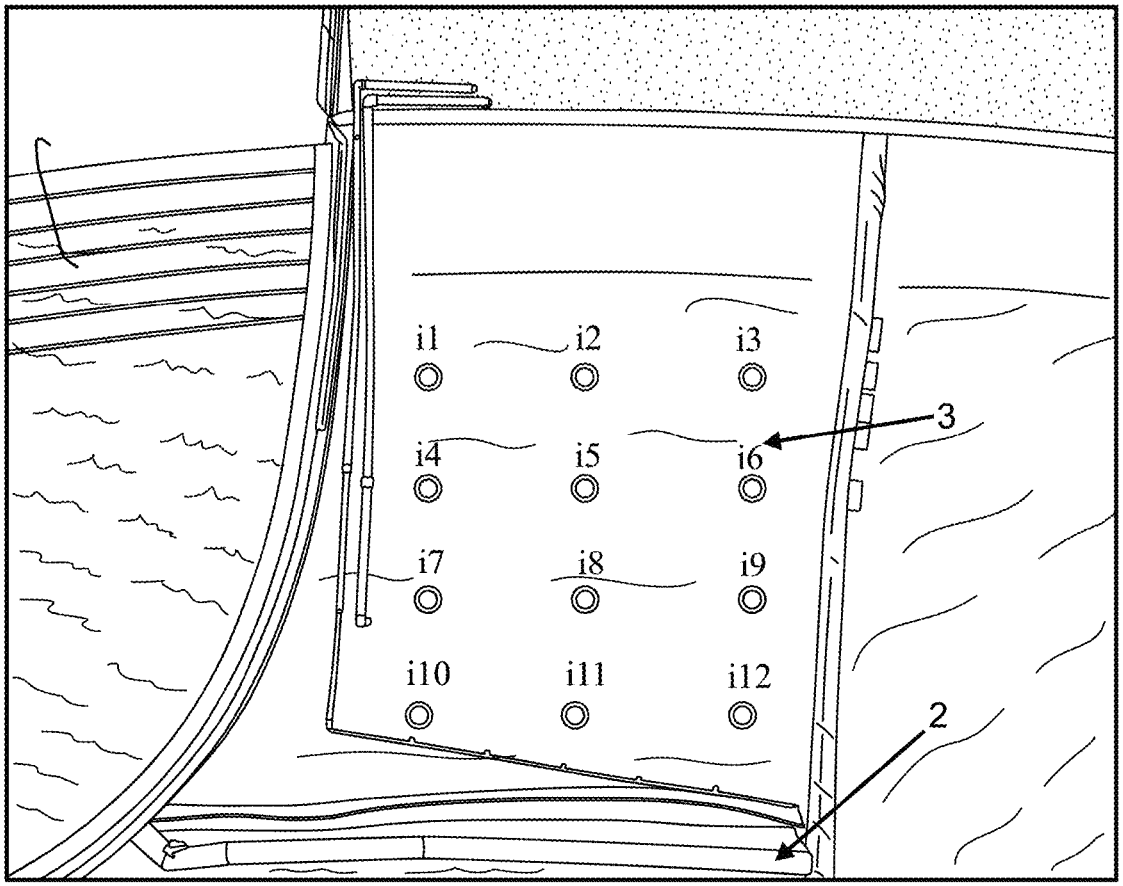
FIG. 18 depicts an aerial photo of referential Example III, showing the partially confined area (3) and the location of sensors i1 to i12 within such area.

The result was a homogeneous mixture of the water within the partially confined area, with no more than 0.5° C. between different points as measured with sensors located within the partially confined area. Sensors were used to measure the temperature of the water being withdrawn from the partially confined area, the temperature of the heated water being discharged from the heating system into the partially confined area, and in twelve locations within the partially confined area, as seen in FIG. 18, where i-1 to i-12 show the location of the different sensors.

The temperature within the partially confined area was maintained at about 28.2-28.7° C. permanently, using an average power of about 45-60 kW in regime (after the initial 28° C. was been achieved in the partially confined area). The system utilized an average of 1,180 kWh of thermal power in a 24-hr period, equivalent to about 300 kWh of electricity in 24 hours used for the operation of the equipment. Therefore, the system achieves a substantially permanent and homogeneous temperature of the water within the partially confined area, using a partial containment system as described above.

It has also been shown that the partial confinement system allows a serpentine flow exchange of water between the partially confined zone and the rest of the lagoon water volume, allowing to maintain homogeneity of such water volume and providing dilution power to the partially confined zone.

While the invention has been particularly shown and described with reference to preferred embodiments thereof, it will be understood by those skilled in the art that various other changes in the form and details may be made therein without departing form the spirit and scope of the invention.

By using the partial confinement system and localized heating system from the present invention, important energy savings are achieved while still allowing comfortable temperatures for direct contact purposes for bathers in a partially confined zone of the water body In the drawings in which like elements are identified with the same designation numeral:

| Number | Element |
|---|---|
| 1 | Water Body |
| 2 | Partial Confinement System |
| 2a | First Barrier Element |
| 2b | Second Barrier Element |
| 2c | Surface connecting means |
| 2d | Buoyancy means for First Barrier Element |
| 2e | Buoyancy means for Second Barrier Element |
| 2f | Bottom anchoring means |
| 2g | Bottom affixing means |

-continued

| Number | Element |
|---|---|
| 3 | Partially Confined Area |
| 4 | Transition Zone |
| 5 | Bottom of the Water Body |
| 6 | Surface of the Water Body |
| 7 | Heating System |
| 7a | Heating Source |
| 7b | External Heating Source |
| 8 | Heated Water Discharge Point |
| 9 | Water Withdrawal Point |
| 10 | Heated Water within the Partially Confined Area |
| 11 | Cold Water outside the Partially Confined Area |
| 12 | Connecting means |
| 13 | Disinfection points |

The invention claimed is:

1. A system for the partial confinement of a water body that creates a thermal barrier and heat plug between two distinct areas within the water body (1), facilitating direct contact recreational activities in a heated environment, comprising:

a first barrier element FBE (2*a*) positioned from the bottom (5) of the water body (1) in an upwardly position, having a vertical length of up to about 95% of the water depth at its position;

a second barrier element SBE (2*b*) positioned from the surface (6) of the water body (1) in a downwardly position, with a submerged depth of up to 95% of the water depth at its position, wherein the second barrier element SBE (2*b*) is located at a horizontal distance (HD) from the first barrier element (2*a*), which creates a transition zone (4); and wherein the horizontal distance (HD) is greater than zero;

connecting means (12) that connect the FBE (2*a*) and the SBE (2*b*) with each other in order to lower variations in the horizontal distance (HD); and wherein the first and second barrier elements form an overlap length (OL).

2. The system for the partial confinement of a water body according to claim 1, wherein the horizontal distance (HD) is equal to, or lower than the overlap length (OL) between the first and second barrier elements.

3. The system for the partial confinement of a water body according to claim 1, wherein the horizontal distance (HD) and the overlap length (OL) are in a ratio of about 1:1 or about 2:3, or about 4:5 or about 1:3 or about 1:2.

4. The system for the partial confinement of a water body according to claim 1, wherein the horizontal distance (HD) is at least 20 cm from the first barrier element (2*a*).

5. The system for the partial confinement of a water body according to claim 1, wherein the overlap length (OL) is at least 20 cm.

6. The system for the partial confinement of a water body according to claim 1, wherein the FBE (2*a*) has a vertical length of up to about 85%, about 75% or about 65% of the depth of the water body where such first barrier element (2*a*) is positioned and wherein the FBE (2*a*) has a vertical length of preferably at least 20%, or at least 35% or at least 50% of the depth of the water of the water body where it is positioned.

7. The system for the partial confinement of a water body according to claim 1, wherein the SBE (2*b*) has a submerged depth of up to about 85%, 75% or 65% of the depth of the water body where such second barrier element (2*b*) is positioned and wherein the FBE (2*a*) has a submerged depth (SD) of preferably at least 20%, or at least 35% or at least 50% of the depth of the water of the water body where it is positioned.

8. The system for the partial confinement of a water body according to claim 1, wherein the connecting means (12) connect the two barrier elements and do not exert a significant flow change within the transition zone.

9. The system for the partial confinement of a water body according to claim 1, wherein the connecting means (12) are selected from the group comprising a string, a cord, a spring, a snap line, a pole, rods, separators and combinations thereof.

10. The system for the partial confinement of a water body according to claim 1, wherein the connecting means are positioned throughout at least one point along the at least two barriers.

11. The system for the partial confinement of a water body according to claim 1, wherein the connecting means are positioned between each other at a distance that is at least the average horizontal distance (HD).

12. The system for the partial confinement of a water body according to claim 1, wherein the first barrier element FBE (2*a*) comprises affixing means to be fixed to the bottom of the body of water, wherein the affixing means create a seal between the bottom of the body of water and the first barrier element FBE (2*a*).

13. The system for the partial confinement of a water body according to claim 12, wherein the first barrier element FBE (2*a*) comprises affixing means selected from the group comprising a fastener, a screw, a bolt, hinge, a joint, a weld, a seam, a webbing, an adhesive, a strip, a tape and combinations thereof.

14. The system for the partial confinement of a water body according to claim 12, wherein the first barrier element FBE (2*a*) is affixed and/or anchored to the bottom through weights, or embedded to the bottom.

15. The system for the partial confinement of a water body according to claim 12, wherein the first barrier element FBE (2*a*) comprises buoyancy means (2*d*) to facilitate the FBE (2*a*) to maintain an upright position and to lower the influence of water currents that may push the FBE (2*a*) from one side to another, wherein buoyancy means are selected from the group comprising one or several buoys, a flotation line, conventional floating means and combinations thereof.

16. The system for the partial confinement of a water body according to claim 15, wherein the first barrier element FBE (2*a*) comprises surface connecting means (2*c*) that connect the upper portion of the FBE (2*a*) to buoyancy means (2*d*), which are selected from a string, a cord, a spring, a snap line, rods, separators, a tether assembly and combinations thereof.

17. The system for the partial confinement of a water body according to claim 1, wherein the second barrier element SBE (2*b*) comprises buoyancy means (2*e*) affixed to its upper portion, the buoyancy means selected from the group comprising: one or several buoys, a flotation line, conventional floating means and combinations thereof and wherein the buoyancy means are positioned either above the surface of the water, below the surface of the water or partially submerged.

18. The system for the partial confinement of a water body according to claim 1, wherein the second barrier element SBE (2*b*) comprises a bottom anchoring means (2*f*) that anchor the second barrier element SBE (2*b*) to the bottom of the water body without exerting a significant flow change.

19. The system for the partial confinement according to claim 18, wherein the bottom anchoring means (2*f*) include a tether assembly, a string, a cord, a chain, a pole, a spring, a snap line, rods, separators, netting materials, and combinations thereof, which can be fixed to the bottom of the water body by means through a fixed support, a dock or combinations thereof.

20. The system for the partial confinement of a water body according to claim 1, wherein the second barrier element SBE (2*b*) is fully or partially embedded to the bottom, and includes materials and elements with perforations to facilitate the flow of water through the SBE or under the SBE (2*d*).

21. The system for the partial confinement of a water body according to claim 18, wherein buoyancy means (2*e*) maintain the SBE within its desired position and act as a buoyancy line to indicate swimmers and bathers within the body of water the limit of the partially confined zone, the limit of the swimming and bathing zone or as any delimiting line that is required.

22. The system for the partial confinement of a water body according to claim 1, wherein the FBE and SBE preferably comprise, or are made of, materials that allow the confinement of water that is in contact with the FBE and the SBE.

23. The system for the partial confinement of a water body according to claim 1, wherein the FBE and the SBE are made of any suitable material having a density close to that of the water in the water body to be partially confined.

24. The system for the partial confinement of a water body according to claim 1, wherein the FBE and the SBE are constructed from materials including light weight materials having either a hollow or filled interior, and preferably a weight located inside and/or outside of the hollow or filled interior in a position to facilitate maintaining the elements in an upright orientation in the water, and, preferably a coupling element at opposite ends allowing adjacent barrier elements to be connected end-to-end.

25. The system for the partial confinement of a water body according to claim 1, wherein the FBE and the SBE are constructed from materials including, but not limited to Polyethylene Terephthalate, High-Density Polyethylene, Polyvinyl Chloride, Polyvinyl Chloride, Polypropylene, Polystyrene and mixtures thereof.

26. The system for the partial confinement of a water body according to claim 1, wherein the FBE and the SBE are made from materials without insulating properties.

27. The system for the partial confinement of a water body according to claim 1, wherein the FBE and the SBE are constructed using heavier weight or density materials, such as concrete, cement or combinations thereof.

28. A localized heating system for creating partially confined heated zones (3) within larger water bodies (1) to facilitate the practice of direct contact recreational activities in a heated environment, comprising:

a) a first barrier element FBE (2*a*) positioned from the bottom (5) of the water body (1) in a substantially upwardly position, wherein the first barrier element (2*a*) has a vertical length of up to about 95% of the water depth of its position;

b) a second barrier element SBE (2*b*) positioned from the surface (6) of the water body (1) in a substantially downwardly position, where the second barrier element (2*b*) has a submerged depth of up to 95% of the water depth of its position, wherein the first and second barrier elements form an overlap length (OL), and wherein the second barrier unit (2*b*) is located at a horizontal distance (HD) from the first barrier element (2*a*), which creates a transition zone (4); and wherein the horizontal distance (HD) is greater than zero;

c) connecting means (12) that connect the FBE and the SBE with each other in order to lower variations in the horizontal distance (HD);

d) at least one water intake point (9) to withdraw water from the water body (1);

e) at least one heated water discharge point (8) to discharge heated water into a partially confined heated zone (3); and f) at least one heating system (7) configured to increase the temperature of the water flow withdrawn from the water intake point (9) and then returns the heated water flow to the partially confined zone (3) through at least one heated water discharge point (8).

29. The localized heating system according to claim 28, wherein the at least one water intake point (9) withdraws water from the partially confined heated zone (3).

30. The localized heating system according to claim 28, wherein the water body (1) has a surface of at least 5,000 $m^2$, more preferably at least 10,000 $m^2$, even more preferably at least 30,000 $m^2$, and most preferably at least 50,000 $m^2$.

31. The localized heating system according to claim 28, wherein the FBE (2*a*) has a vertical length of up to about 85%, about 75% or about 65% of the depth of the water body where such first barrier element (2*a*) is positioned and wherein the FBE (2*a*) has a vertical length of preferably at least 20%, or at least 35% or at least 50% of the depth of the water of the water body (1) where it is positioned.

32. The localized heating system according to claim 28, wherein the SBE (2*b*) has a submerged depth of up to about 85%, 75% or 65% of the depth of the water body where such second barrier element (2*b*) is positioned and wherein the FBE (2*a*) has a submerged depth (SD) of preferably at least 20%, or at least 35% or at least 50% of the depth of the water of the water body where it is positioned.

33. The localized heating system according to claim 28, the system being suitable to be used in natural water bodies like the sea, lakes, lagoons, reservoirs, estuaries, and/or ponds.

34. The localized heating system according to claim 28, the system being suitable to be used in man-made water features, such as a high transparency man-made lagoon constructed with recent technologies.

35. The localized heating system according to claim 28, wherein the first and second barrier elements are attached or affixed to an edge of the water body in a zone where a slope of between 0% and 30% is present.

36. The localized heating system according to claim 28, wherein the first and second barrier elements are attached or affixed to a wall of the body of water.

37. The localized heating system according to claim 28, wherein the first and second barrier elements are positioned within the water body at a distance of at least 5 m from an edge of the water body.

38. The localized heating system according to claim 28, wherein the first and second barrier elements are positioned within the water body so that the partially confined area has a volume of at least 100 $m^3$.

39. The localized heating system according to claim 28, wherein the heating system (7) comprises at least a heat pump.

40. The localized heating system according to claim 28, wherein the heating system (7) comprises at least a heat exchanger.

41. The localized heating system according to claim 40, wherein the heat exchanger uses energy from an energy generating source, such as an oil, electricity, gas or carbon energy source.

42. The localized heating system according to claim 28, wherein the horizontal distance (HD) is equal to, or lower than the overlap length (OL) between the first and second barrier elements.

43. The localized heating system according to claim 28, wherein the horizontal distance (HD) and the overlap length (OL) are in a ratio of about 1:1 or about 2:3, or about 4:5 or about 1:3 or about 1:2.

44. The localized heating system according to claim 28, wherein the horizontal distance (HD) is at least 20 cm from the first barrier element (2*a*).

45. The localized heating system according to claim 28, wherein the overlap length (OL) is at least 20 cm.

46. The localized heating system according to claim 28, wherein the connecting means (12) connect the two barrier elements and do not exert a significant flow change within the transition zone.

47. The localized heating system according to claim 28, wherein the connecting means (12) are selected from the group comprising a string, a cord, a spring, a snap line, a chain, a pole, rods, separators, and combinations thereof.

48. The localized heating system according to claim 28, wherein the connecting means are positioned throughout at least one point along the at least two barriers.

49. The localized heating system according to claim 28, wherein the connecting means are positioned between each other at a distance that is at least the average horizontal distance (HD).

50. The localized heating system according to claim 28, wherein the first barrier element FBE (2*a*) comprises bottom affixing means (2*g*) to be fixed to the bottom of the body of water, the affixing means are selected from the group comprising: a fastener, a screw, a bolt, hinge, a joint, a weld, a seam, a webbing, an adhesive, a strip, a tape and combinations thereof and wherein preferably, the affixing means create a seal between the bottom of the body of water and the first barrier element FBE (2*a*).

51. The localized heating system according to claim 50, wherein the bottom affixing means (2*g*) comprise a hinge mechanism to retract the barrier element.

52. The localized heating system according to claim 50 wherein the first barrier element FBE (2*a*) is affixed and/or anchored to the bottom through weights, or embedded to the bottom.

53. The localized heating system according to claim 50 wherein the first barrier element FBE (2*a*) comprises buoyancy means (2*d*) to facilitate the FBE (2*a*) to maintain an upright position and to lower the influence of water currents that may push the FBE (2*a*) from one side to another, wherein buoyancy means are selected from the group comprising one or several buoys, a floatation line, conventional floating means and combinations thereof.

54. The localized heating system according to claim 53 wherein the first barrier element FBE (2*a*) comprises surface connecting means (2*c*) that connect the upper portion of the FBE (2*a*) to buoyancy means (2*d*), which are selected from a string, a cord, a spring, a snap line, rods, separators, a tether assembly and combinations thereof.

55. The localized heating system according to claim 28, wherein the second barrier element SBE (2*b*) comprises buoyancy means affixed to its upper portion, the buoyancy means selected from the group comprising a buoy and a floatation line and combinations thereof.

56. The localized heating system according to claim 28, wherein the second barrier element SBE (2*b*) comprises bottom anchoring means (2*f*) that anchor the second barrier element SBE (2*b*) to the bottom of the water body without exerting a significant flow change.

57. The localized heating system according to claim 56, wherein bottom anchoring means (2*f*) include a tether assembly, a string, a cord, a chain, a pole, a spring, a snap line, rods, separators, netting materials, and combinations thereof, which can be fixed to the bottom of the water body by means through a fixed support, a dock or combinations thereof.

58. The localized heating system according to claim 56, wherein the second barrier element SBE (2*b*) is fully or partially embedded to the bottom, and includes materials and elements with perforations to facilitate the flow of water through the SBE or under the SBE (2*d*).

59. The localized heating system according to claim 28, wherein the second barrier element SBE (2*b*) comprises buoyancy means (2*e*) affixed to its upper portion, the buoyancy means (2*e*) selected from the group comprising one or several buoys, a flotation line, conventional floating means and combinations thereof and wherein the buoyancy means are positioned either above the surface of the water, below the surface of the water or partially submerged.

60. The localized heating system according to claim 28, wherein buoyancy means (2*e*) serve as a means to maintain the SBE within its desired position as well as to act as a buoyancy line to indicate swimmers and bathers within the body of water the limit of the partially confined zone, the limit of the swimming and bathing zone or as any delimiting line that is required.

61. The localized heating system according to claim 28, wherein the FBE and SBE preferably comprise, or are made of, materials that allow the confinement of water that is in contact with said FBE and the SBE.

62. The localized heating system according to claim 28, wherein the FBE and the SBE are made of any suitable material having a density close to that of the water in the lagoon to be partially confined.

63. The localized heating system according to claim 28, wherein the FBE and the SBE may be constructed include, but are not limited to light weight materials having either a hollow or filled interior, and preferably a weight located inside and/or outside of the hollow or filled interior in a position to facilitate maintaining the elements in an upright orientation in the water, and, preferably a coupling element at opposite ends allowing adjacent barrier elements to be connected end-to-end.

64. The localized heating system according to claim 28, wherein the FBE and the SBE may be constructed include, but are not limited to Polyethylene Terephthalate, High-Density Polyethylene, Polyvinyl Chloride, Polyvinyl Chloride, Polypropylene, Polystyrene and mixtures thereof.

65. The localized heating system according to claim 28, wherein the FBE and the SBE are made from materials that do not necessarily need to have insulating properties.

66. The localized heating system according to claim 28, wherein the at least one heating system (7) increases the temperature of the withdrawn water flow, in at least about 1° C., or at least about 3° C.

* * * * *